US005295814A

United States Patent [19]

Uebel

[11] Patent Number: 5,295,814

[45] Date of Patent: Mar. 22, 1994

[54] TROCHOIDAL ROTARY PISTON MACHINE WITH PISTON FOLLOW-UP MECHANISM

[75] Inventor: Helmuth R. Uebel, Groton, Australia

[73] Assignee: Archimedes Associates Inc., Groton, Conn.

[21] Appl. No.: 847,014

[22] PCT Filed: Oct. 4, 1990

[86] PCT No.: PCT/AU90/00479

§ 371 Date: Apr. 6, 1992

§ 102(e) Date: Apr. 6, 1992

[87] PCT Pub. No.: WO91/05143

PCT Pub. Date: Apr. 18, 1991

[30] Foreign Application Priority Data

Oct. 4, 1989 [AU] Australia ..... PJ6704

[51] Int. Cl.[5] ..... F01C 1/10; F01C 17/06; F01C 19/04; F01C 19/08

[52] U.S. Cl. ..... 418/60; 418/61.3; 418/111; 418/129; 418/142; 418/144

[58] Field of Search ..... 418/60, 61.3, 111, 129, 418/142, 144

[56] References Cited

U.S. PATENT DOCUMENTS

| | | | |
|---|---|---|---|
| 731,283 | 6/1903 | Cooley . | |
| 1,789,842 | 1/1931 | Rolaff | 418/111 |
| 2,395,824 | 12/1938 | Herman . | |
| 3,062,435 | 11/1962 | Bentele | 418/60 |
| 3,185,386 | 5/1965 | Peras | 418/144 |
| 3,410,254 | 11/1968 | Huf . | |
| 3,549,282 | 12/1970 | Woodling | 418/60 |
| 3,556,695 | 1/1971 | Yamamoto . | |
| 3,797,974 | 3/1974 | Huf . | |
| 3,884,600 | 5/1975 | Gray | 418/61.2 |
| 3,885,897 | 5/1975 | Huf . | |
| 3,885,898 | 5/1975 | Lamm . | |
| 3,909,163 | 9/1975 | Huf | 418/61.3 |
| 3,920,359 | 11/1975 | Gray . | |
| 3,923,430 | 12/1975 | Huf | 418/61.3 |
| 3,996,901 | 12/1976 | Gale et al. | 418/61.3 |
| 4,008,017 | 2/1977 | Hennig . | |
| 4,008,982 | 2/1977 | Traut . | |
| 4,018,548 | 4/1977 | Berkowitz | 418/144 |

FOREIGN PATENT DOCUMENTS

| | | |
|---|---|---|
| 522299 | 3/1931 | Fed. Rep. of Germany . |
| 997419 | 7/1960 | United Kingdom . |
| 947506 | 1/1964 | United Kingdom . |
| 995248 | 6/1965 | United Kingdom . |
| 1109533 | 4/1968 | United Kingdom . |
| 1111011 | 4/1968 | United Kingdom . |
| 1160170 | 7/1969 | United Kingdom . |
| 2184490 | 6/1987 | United Kingdom . |

*Primary Examiner*—John J. Vrablik

*Attorney, Agent, or Firm*—Sughrue, Mion, Zinn, Macpeak & Seas

[57] ABSTRACT

A rotary piston machine (64) of trochoidal construction with a piston (36) of epitrochoidal type with 1:1 generating circles and defined with an outer envelope and a follow-up mechanism (50) for the piston comprising a pair of relatively offset eccenters (52, 54) mounted for eccentric rotation about a drive shaft (14) with the piston, the eccenters (52, 54) being rotatably mounted in respective guide members (58, 60) which are constrained to reciprocate rectilinearly along angularly offset paths, the pair of eccenters (52, 54) being immediately adjacent the piston (36) and secured for rotation directly therewith. Where two or more pistons (36) are provided, each will have a respective follow-up mechanism (50). The piston (36) and follow-up mechanism (50) are mounted on an eccentric portion (30) of the drive shaft (14) which may be stepped with the eccenters (52, 54) being mounted about a reduced diameter portion (32). The eccenters (52, 54) may be separable from the piston (36). The machine (64) may be of modular construction with the piston (36) in one module (20) and each eccenter (52, 54) movable in respective further modules (22, 26).

55 Claims, 12 Drawing Sheets

TROCHOIDAL ROTARY PISTON MACHINE WITH PISTON FOLLOW-UP MECHANISM

BACKGROUND OF THE INVENTION

The present invention relates to rotary piston machines of trochoidal design, particularly of the epitrochoidal type. In these machines, some form of guide or follow-up drive mechanism is required to ensure that the piston rotates in a controlled manner about a drive shaft in the opposite direction to the rotation of the drive shaft, and the present invention is particularly, but not essentially, concerned with such a follow-up drive mechanism.

The best known version of a rotary engine of trochoidal design of the epitrochoidal type is the Wankel engine, and the widely accepted best solution to the piston follow-up mechanism for the Wankel engine is a 3:2 gear drive. The Wankel engine uses a piston of the epitrochoidal type defined with an inner envelope.

In rotary piston machines of trochoidal design in which the piston substantially conforms to an epitrochoid having 1:1 generating circles, the follow-up drive mechanism must produce a 2:1 ratio. There have been many proposals to produce this type of drive using a gear driven direct kinematic follow-up mechanism for such a machine in which the piston is defined with an outer envelope, but for a given eccentricity or stroke of the piston on the drive shaft the diameters of the gears are fixed and the static gear must have a pitch circle diameter equal to 4 times the eccentricity of the drive shaft. Furthermore, in order to fit the gears and piston to the eccentric part of the drive shaft it is necessary to manufacture the drive shaft in two parts. In practice these requirements mean that a considerable necking down and therefore weakening of the drive shaft may be required in the area of the smaller pinion gear, to such an extent that the reduced strength of the drive shaft may virtually eliminate the possibility of constructing a multiple piston engine. Also, the rapidly fluctuating loads on the gears will tend to reduce the life of the gears, and the accuracy of the positioning of the piston will become unacceptable with increasing gear wear as the piston will then tend to be able to contact the housing.

One proposal avoiding the use of gears in a 2:1 follow-up drive mechanism for an epitrochoidal rotary piston is made in U.S. Pat. Nos. 3,909,163 and 3,923,430 in which an eccentric elongate rotary body is disposed on a continuous drive shaft for rotation therewith, a sleeve is disposed over the rotary body for rotation relative thereto, one or more rotary pistons are mounted on the sleeve for rotation therewith and a single follow-up mechanism is provided on the sleeve for all of the pistons. The follow-up drive mechanism comprises a pair of offset eccenters mounted on the sleeve for rotation therewith and with the or each piston, from which they are axially spaced. The eccenters are rotatable within respective guide mechanisms which are constrained to reciprocate along rectilinear paths by relatively inclined straight rods. This mechanism operates on the principle that any fixed chosen point on the or each piston will trace an elliptical path relative to the housing when the piston rotates with its correct relative motion with respect to the drive shaft and housing, that is at twice the angular velocity of the drive shaft but in the opposite direction. If the chosen point on the piston is spaced from the eccentric axis of the piston by a distance equal to the piston eccentricity from the axis of rotation of the drive shaft, the ellipse traced on the housing by the fixed point on the piston becomes a straight line. This is a special case of the ellipse when its minor axis becomes zero. Therefore, to obtain the required synchronised motion any point on the piston or fixed relative to the piston at a radius equal to the drive shaft eccentricity from the axis on which the piston rotates must be constrained to move in a straight line through the axis of the drive shaft.

While the proposal in the aforementioned U.S. patent specifications alleviates the necking down of the drive shaft which is required with a direct kinematic gear driven follow-up mechanism, it requires very substantial counter balancing to balance the substantial weight of the rotating body eccentrically mounted for rotation with the drive shaft. Furthermore, since the eccentric rotating body and sleeve mounted for rotation relative thereto are continuous through each piston the unbalanced mass of the eccentric rotating body will increase for each additional piston and the distance between the main bearings at each end of the engine may be very large. It is not practical to have bearings between the end bearings. Even for a single piston engine, the spacing between the eccenters and the piston is substantial requiring well spaced drive shaft bearings. Also, for a multiple piston engine of this design, since all of the pistons are mounted on the one continuous sleeve, each trochoidal housing for an associated piston, and the corresponding plugs and ports, must be angularly offset relative to the others, leading to an engine which may be costly and very difficult to build and service.

The proposal in U.S. Pat. No. 4,086,038 uses a similar follow-up drive mechanism to that in the aforementioned U.S. Patent Specifications but the rotating body and sleeve is replaced by a reduced diameter shaft which is journalled for eccentric rotation relative to the divided drive shaft, with the piston or all of the pistons and the associated guide mechanism fixed for rotation with the reduced diameter shaft. All of the pistons must be on the one reduced diameter shaft and, as with the aforedescribed proposal, there is only one follow-up mechanism for all of the pistons which is equally spaced from the pair of pistons illustrated, all of which means an excessive distance between the main bearings of the drive shaft. Furthermore, it is possible for the opposed portions of the drive shaft to move out of phase due to deflection under load which will tend to cause excessive friction and ultimately seizure with the pistons fouling the housing.

SUMMARY OF THE INVENTION

It is an object f one aspect of the present invention to provide a follow-up drive mechanism generally of the type described above in relation to the U.S. Patent Specifications in which one or more of the described disadvantages is alleviated.

According to a first aspect of the present invention there is provided a rotary piston machine of trochoidal construction comprising a rotatable drive shaft, a piston eccentrically mounted on the drive shaft for contra rotation relative thereto in a housing, the piston being of epitrochoidal type with 1:1 generating circles and defined with an outer envelope and the housing having a co-operating working surface for the piston which substantially conforms to the outer envelope of the epitrochoid, and a piston follow-up mechanism comprising a pair of relatively offset eccenters mounted for eccentric rotation about the drive shaft with the piston, said eccenters being rotatably mounted in respective guide members which are constrained by respective guiding means to reciprocate rectilinearly along angularly offset paths with rotation of the piston, and wherein the pair of eccenters is immediately adjacent the piston and secured for rotation directly therewith.

By the first aspect of the present invention the axial distance along the drive shaft occupied by the piston and associated follow-up mechanism may be substantially reduced allowing for the possibility of shorter axial distances between adjacent drive shaft main bearings. Furthermore, by securing the pair of eccenters for rotation directly with the piston there is no requirement for a single bearing sleeve which extends fully between the piston and the eccenters.

According to a second aspect of the present invention there is provided a rotary piston machine of trochoidal construction comprising a rotatable drive shaft, a plurality of pistons eccentrically mounted on the drive shaft for contra rotation relative to the drive shaft in a housing, each piston being of epitrochoidal type with 1:1 generating circles and defined with an outer envelope and the housing having respective co-operating working surfaces for the pistons each of which substantially conforms to the outer envelope of the respective epitrochoid, and piston follow-up means comprising a respective follow-up mechanism for each piston comprising a pair of relatively offset eccenters mounted for eccentric rotation about the drive shaft with the associated piston, said eccenters being rotatably mounted in respective guide members which are constrained by respective guiding means to reciprocate rectilinearly along angularly offset paths with rotation of the piston.

By the second aspect of the invention, in a multiple piston machine, each piston has an associated follow-up mechanism whereby there is no need to have a continuous mounting for all of the pistons and one follow-up mechanism which is rotatable relative to the drive shaft meaning in turn that it is possible to provide drive shaft bearings between adjacent assemblies of piston and follow-up mechanism.

It will be appreciated that the first and second aspects of the invention may be combined in one machine or may be used separately.

The eccenters may be on opposite sides of the associated piston but are preferably disposed to one side. The eccenters are advantageously, but not necessarily, mounted for rotation about the drive shaft in engagement therewith, for example by way of an associated bearing. The eccenters are rotatable about an axis of identical eccentricity to the piston relative to the main axis of the drive shaft. Where the eccenters rotate in engagement with the drive shaft, the eccentric portion of the drive shaft on which the piston and eccenters are mounted may be of constant diameter, but advantageously comprises a stepped crank pin with the portion about which the eccenters rotate being of reduced diameter compared to the portion about which the piston rotates.

Advantageously, the eccenters are selectively separable from the associated piston to reduce the axial length of the piston and eccenter assembly. This facilitates assembling the rotary piston machine and particularly allows for a shorter one-piece drive shaft since each portion of the drive shaft need only be sufficiently long to accommodate separately the piston and/or the eccenters. The separable pair of eccenters may comprise a unitary casting where they are to be disposed on the same side of the piston, but if the pair of eccenters is to be disposed on the same side of the piston on a stepped crank pin, it may be necessary for the pair to be split along an axial plane (or two or more axial planes) so as to enable it to be mounted on the crank pin.

Theoretically, only one eccenter is required to provide the necessary follow-up control for the associated piston, but because the axis of the straight line motion of the respective guide member passes through the drive shaft main axis there is a period of indeterminate motion and the second eccenter and corresponding guide member and rectilinear guiding means controls the motion at this time so that there is no dead point in the cycle. It is not necessary for the rectilinear motion to be along the maximum and minimum axes of the housing working surface since any diametrical line of a circle centered on the drive shaft main axis and having a radius of two piston eccentricities perpendicular to said main axis will provide the desired synchronising motion for the piston. However, the maximum and minimum axes or coordinates of the working surface are the preferred choice in an engine because these two lines provide the highest accuracy in the positioning of the piston, may provide the greatest amount of support for the drive shaft from the follow-up mechanism and may result in the most compact engine.

The rectilinear guiding means may comprise respective pairs of straight rods as in the aforementioned U.S. patent specifications, but preferably comprises opposed parallel straight walls of the housing defining a guide path in which a respective one of the guide members comprising a guide block is free to slide. Preferably, but not necessarily, the angularly offset guide paths are perpendicular to each other. The guide block sides may be an exact square so that when one opposed pair of sides becomes worn, the guide block may be rotated through 900 and the other opposed pair of sides used instead. Since all points on the guide block travel in a straight line any part of the guide block can be constrained to move in the appropriate straight line. Thus, alternative examples are one or more shaped or straight pins on one of the block and housing and a corresponding groove or grooves on the other of the block and housing. There are many other ways in which each eccenter can be constrained to move in the appropriate straight line, including constraining the guide member by means of a Watts linkage.

Preferably the drive shaft comprises a one piece construction, and in a multipiston machine the drive shaft advantageously has plural balanced throws for the pistons. The resultant angularly of f set arrangement of the eccentric portions of the drive shaft enables the engine to be readily assembled with the substantially trochoidal working surfaces associated with the respective pistons being aligned so that all of the combustion chambers and corresponding components such as plugs and ports can also be aligned.

Advantageously, and according to a further aspect of the invention which may be used with or without either or both of the first and second aspects, the machine housing is in modular form with, for the or each piston assembly, a first module containing the piston and defining the co-operating working surface therefor, a second module containing a first of the eccenters and respective guide member and carrying the respective guiding means, and a third module containing a second of the eccenters and respective guide member and carrying the respective guiding means. Where the guiding means comprise respective pairs of opposed parallel straight walls of the housing, such an arrangement of modules may considerably facilitate machining of the walls. The sides of the working volume may be defined by the second and third modules on opposite sides of the first module, or more preferably may be defined by the associated second module and by the third module of an adjacent piston assembly which may conveniently contain porting for the working volume of the first module of the first-mentioned piston assembly. Where the first-mentioned piston assembly is an end piston assembly or the only piston assembly the adjacent third module may be passive in that it is not associated with a respective piston assembly. Similarly the third module of the first-mentioned piston assembly may comprise an end module where it is an end or the only piston assembly or may contain the porting of an adjacent piston assembly. Advantageously, a main bearing for the drive shaft is supported in the or each third module. A thrust bearing designed to take up any axial movement in the drive shaft may be provided in a second end module. In the case of a one piece drive shaft and one piece modules, each of the modules must be able to be displaced axially along the drive shaft as necessary. Thus, any main bearing disposed in the third module must be located in an aperture in the third module sufficiently large to permit the drive shaft to be passed therethrough. Alternatively, one or more of the modules may be split to permit location around the drive shaft.

BRIEF DESCRIPTION OF THE DRAWINGS

Various embodiments of a rotary piston machine in accordance with the present invention will now be described by way of example only with reference to the accompanying drawings in which:

FIG. 5C is a part sectional view along the line 5C-5C of FIG. 5A;

DETAILED DESCRIPTION OF THE INVENTION

Figure 2:
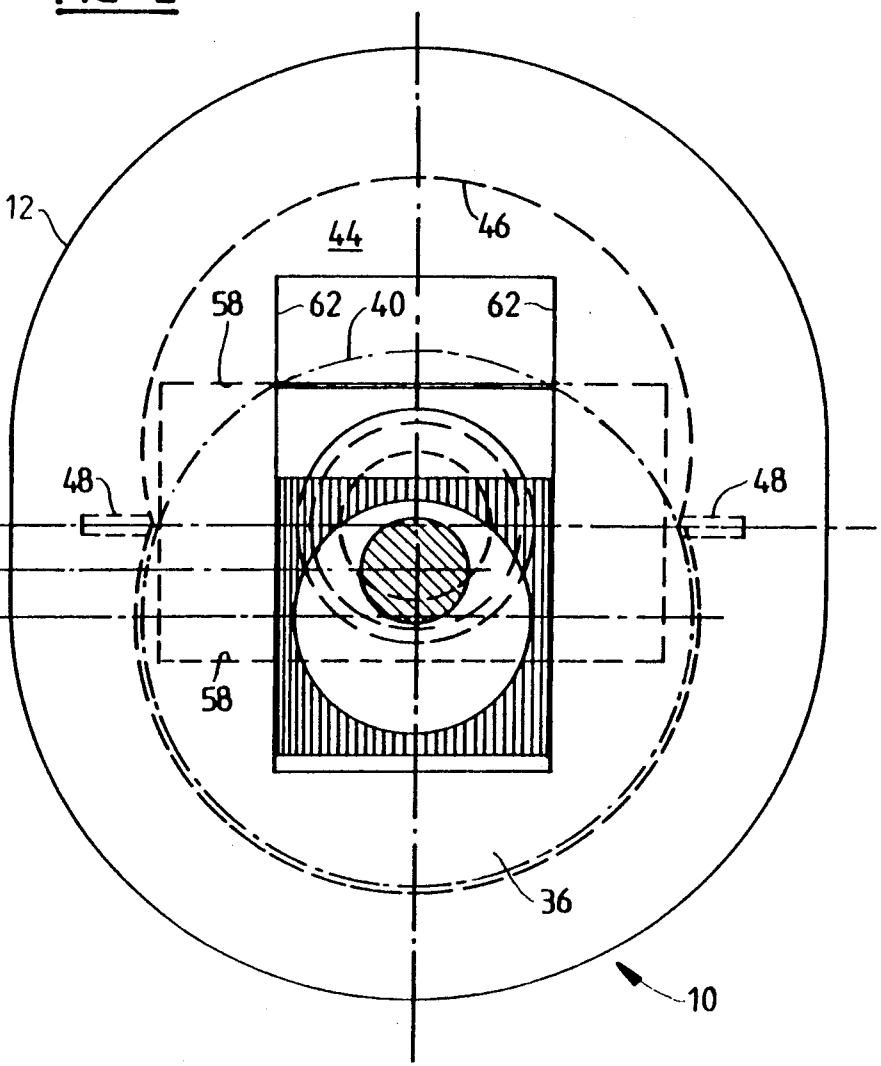
FIG. 2 is a part sectional view along the line 2—2 in FIG. 1.
Figure 1:
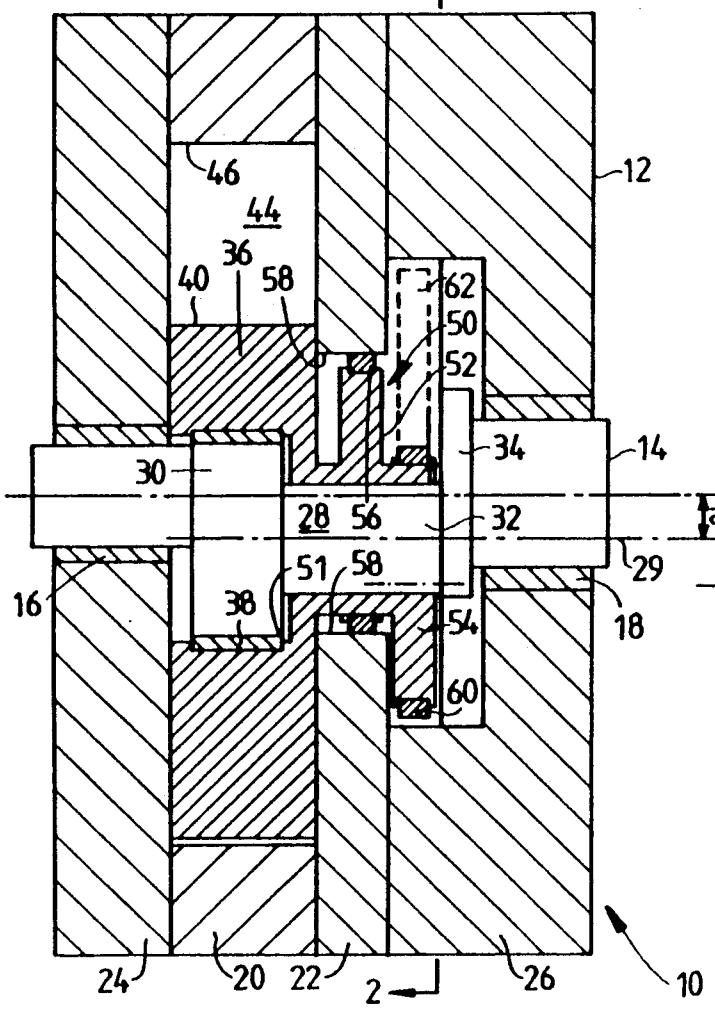
FIG. 1 is an axial section through a schematic representation of a first embodiment of rotary piston machine in accordance with the first aspect of the present invention.

Referring to FIGS. 1 and 2, a rotary piston machine 10 comprises a housing 12 with a crank shaft 14 supported for rotation about axis 15 in axially spaced plain bearings 16 and 18. The housing 12 is of modular form comprising a first module 20, a second module 22 and end modules 24 and 26 in which the bearings 16 and 18, respectively, are mounted.

The crank shaft 14 has a stepped crank pin 28 comprising a first portion 30 of relatively large diameter and a second portion 32 of relatively small diameter extending between the first portion 30 and a crank web 34. The crank pin 28 has an axis 29 which has an eccentricity a relative to the axis 15 of the crank shaft 14.

The large diameter portion 30 of the crank pin 28 carries a rotary piston 36 within the first module 20 of the housing 12. The piston 36 is rotatably mounted on the crank pin portion 30 by means of a bearing 38. The piston 36 is essentially of cardioidal shape as illustrated schematically by a chain dotted line in FIG. 2. Thus, the piston is of epitrochoidal type with 1:1 generating circles defined with an outer envelope. The piston is shown with an inflexion free side 40 but that side may incorporate an inflexion.

The piston 36 rotates about the rotating crank shaft 14 in a working volume 44 defined at the periphery by the module 20 and at the sides by the modules 22 and 24 respectively of the housing 12. The module 20 defines a cooperating working surface 46 for the piston which substantially conforms to the outer envelope of the eccentrically rotatable cardioidal piston 36. The periphery of the piston 36 conforms substantially to the mathematically exact trochoid and the cooperating working surface 46 is correspondingly shaped. As the piston 36 rotated about the crank pin 28 it remains permanently in contact with opposed radial seals 48 mounted in the housing module 20 at respective inflexions in the cooperating working surface 46.

The described shapes of the piston 36 and cooperating working surface 46 require that the piston rotates on the crank shaft 14 at twice the angular velocity of the crank shaft but in the opposite direction. The required synchronised motion is achieved by an eccenter assembly 50 connected directly with the piston 36 and comprising a pair of axially spaced angularly offset eccenters 52 and 54 mounted for rotation about the drive shaft 14 with the piston 36 on respective axes. Each of the eccenters 52 and 54 has an axis which is spaced from the crank pin axis 29 by the distance a equal to the eccentricity of the crank pin 28 from the crankshaft axis 15. Thus, eccenter 54 has an axis 42 and, conveniently, eccenter 52 is shown on the axis 15 of the crank shaft. The eccenter assembly 50 is disposed immediately axially adjacent the piston thereby ensuring that the axial distance between the main bearings 16 and 18 is minimal. By the term "axially spaced" as used in relation to the eccenters is meant merely that they are not radially aligned. The eccenters may be immediately axially adjacent or spaced slightly as shown.

The eccenter 52 is rotatably received in a first guide block 56 which is constrained to reciprocate rectilinearly in a horizontal direction (in FIGS. 1 and 2) by opposed guide surfaces 58 in the module 22 of the housing. The eccenter 54 is rotatably received in a corresponding guide block 60 which is constrained to reciprocate rectilinearly in a vertical direction (in FIGS. 1 and 2) by opposed guide Surfaces 62 (one only shown in FIG. 1) in the module 26 of the housing 12. Because they are provided in respective modules the opposed guide surfaces 58 and 62 may be readily machined as desired.

The guide blocks 56 and 60 are able to reciprocate linearly along their respective paths because the associated eccenter is caused to rotate about an axis which is at a distance of one crank pin eccentricity a from the axis 29 of the crank pin 28. It is not necessary that the guide blocks 56 and 60 reciprocate linearly along the major and minor axis of the piston outer envelope defining the cooperating working surface 46, but this is preferred as shown in FIG. 2 because it provides the optimum accuracy in the positioning of the piston, the greatest amount of support to the crank shaft from the eccenter assembly 50 and may result in the most compact engine. It is also not necessary that the guide blocks 56 and 60 reciprocate perpendicularly to each other.

The above described features of the eccenter assembly 50 and guide mechanism are applicable to all of the embodiments described herein and for convenience will not be described again in detail in relation to them.

It will be appreciated that in order for the rotary piston machine 10 of FIGS. 1 and 2 to be assembled, either the crank shaft 14 must be separable into two parts at one or other end of the smaller diameter crank pin portion 32 or the eccenter assembly 50 must be separable from the piston 36 at position 51 and must divide generally parallel to the axis. For convenience, the porting for the rotary piston machine has not been shown in FIGS. 1 and 2, but the machine 10 can be readily adapted for use as a driven or driving machine, such as a pump, an internal combustion engine or a pneumatic engine.

The eccenter assembly 50 is mounted for rotation on the reduced diameter portion 32 of the crank pin 28 which enables the motor to be more compact radially than would be the case without the stepped crank pin. However, without the stepped crank pin the eccenter assembly could be integral with the piston 36 yet still provide the advantage of axial compactness by ensuring that the eccenter assembly is immediately adjacent the piston, thereby allowing for a minimal separation of the crank shaft bearings 16 and 18.

Figure 3:
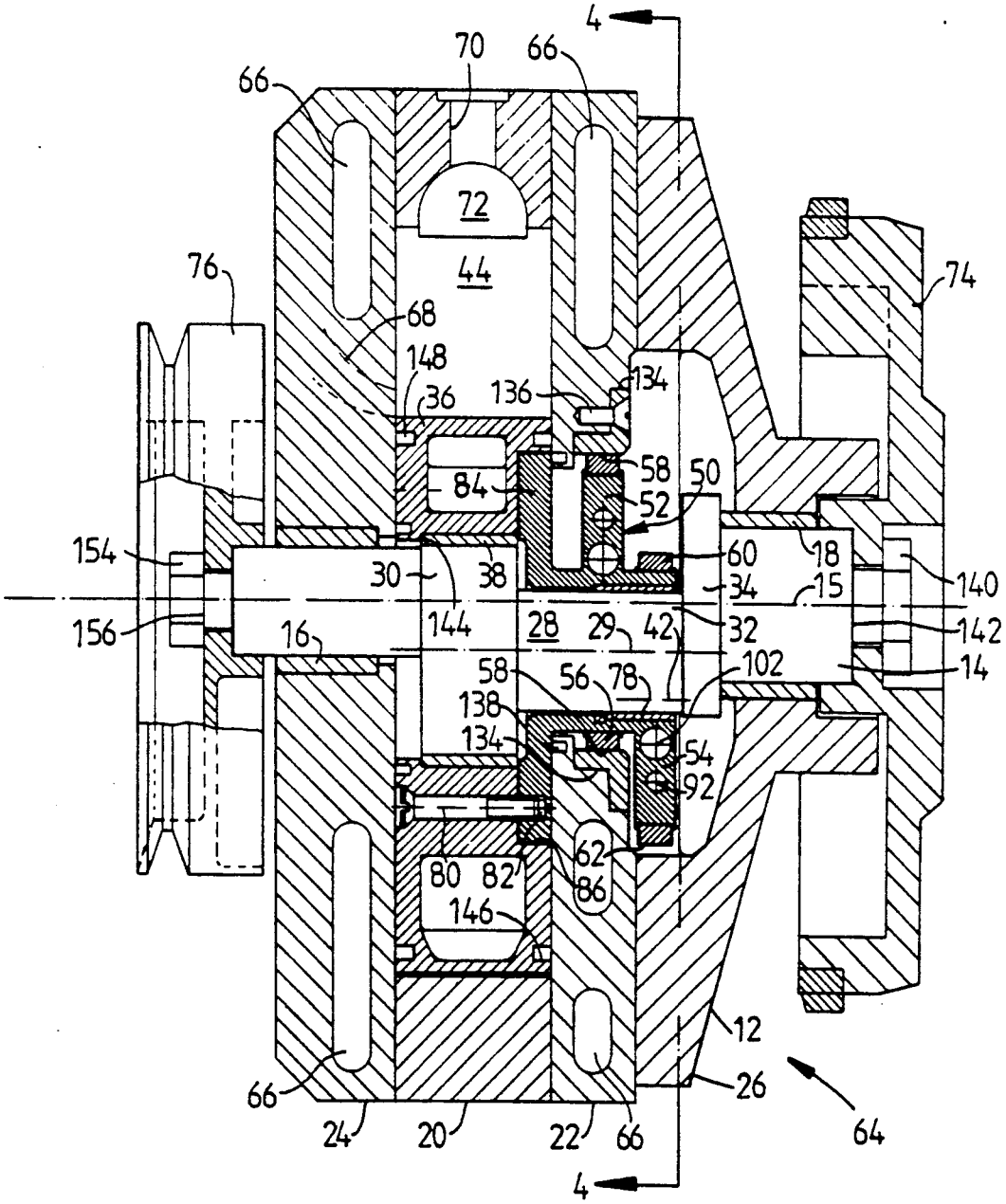
FIG. 3 is an axial section through a second embodiment of a single piston rotary piston engine in accordance with the first aspect of the invention.
Figure 4:
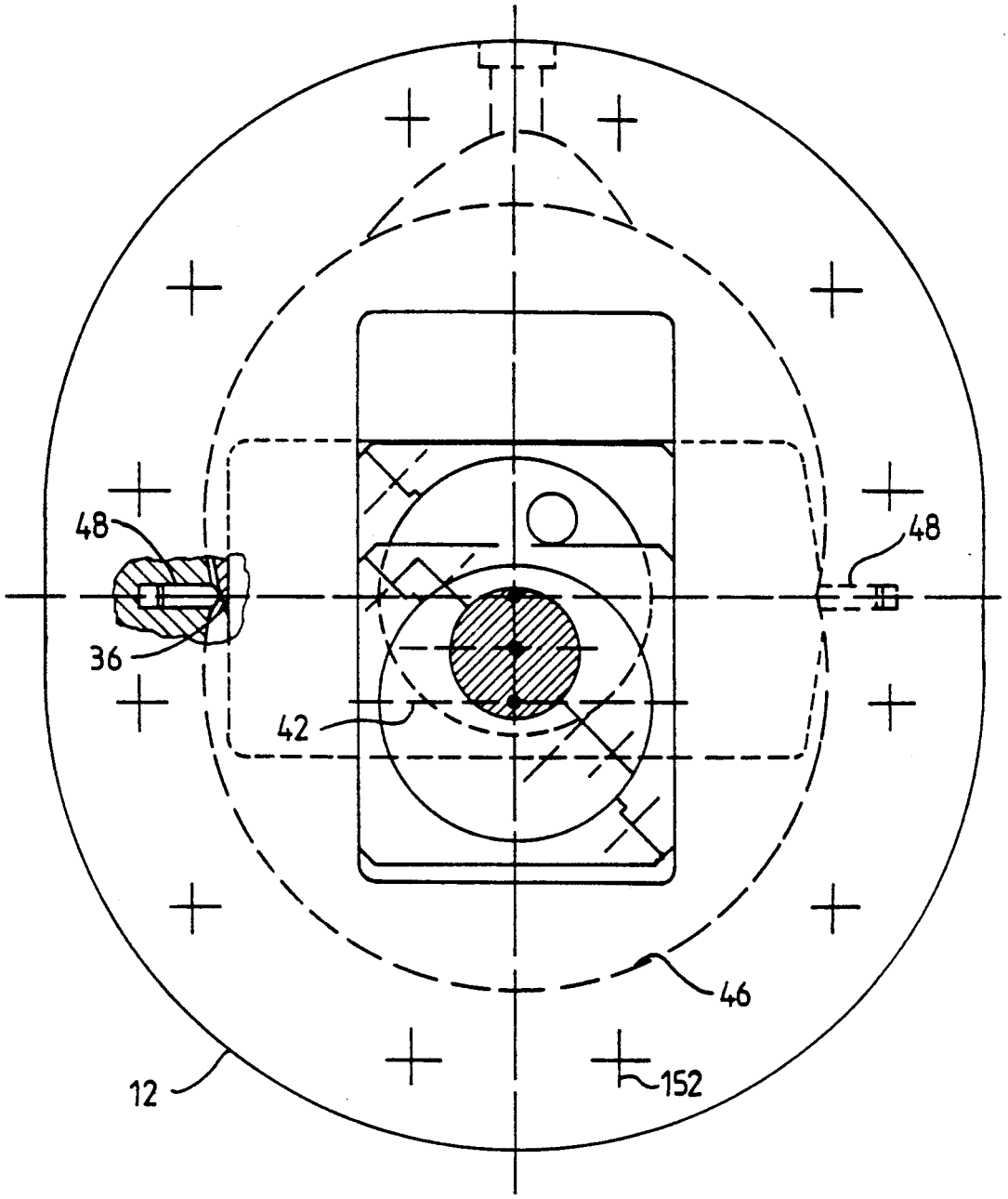
FIG. 4 is a part sectional view along the line 4—4 of FIG. 3.

Referring now to FIGS. 3 and 4 there is shown an embodiment of a single piston rotary piston engine 64 in accordance with the first aspect of the present invention incorporating many of the features of the machine 10 of FIGS. 1 and 2. For convenience, the same or similar parts in the embodiment of FIGS. 3 and 4 and in subsequent embodiments will be given the same reference numerals as used with reference to the machine 10 of FIGS. 1 and 2.

The rotary piston engine 64 shown in FIGS. 3 and 4 is water cooled and water cooling channels 66 are shown in modules 22 and 24 of the housing 12. Also partly represented in FIG. 3 is a port 68 (shown in dotted lines) for the working volume 44, the port 68 being provided in the module 24. Module 20 includes a screw threaded port 70 to receive a spark plug or other ignition device (not shown), the port 70 opening into a combustion chamber 72 in the working volume 44. The piston 36 is hollow to minimise the eccentrically rotating mass thereof, and the crank shaft 14 at one end carries a balanced fly wheel 74, the balancing weight being minimal in view of the reduced eccentric mass rotating on the crank pin. At its other end the crank Shaft 14 carries an accessory pulley 76 shaped in known manner to receive a V-belt (not shown). The pulley 76 may also provide some balancing of the rotating mass.

The crank pin 14 has essentially the same shape as the crank pin in rotating piston machine 10 and the eccenter assembly 50 is mounted for rotation on the relatively small diameter portion 32 of crank pin 28, by way of a plain bearing 78, the rotor 36 being rotatably mounted on the relatively large diameter portion 30 of the crank pin. The eccenter assembly 50 is secured for rotation with the rotor 36 by way of six angularly spaced bolts 80 (one only shown) passing through the rotor parallel to the axis of rotation and engaging cooperating screw threaded openings 82 in a flange 84 of the assembly 50. Flange 84 is received as a close fit in a corresponding recess 86 in the adjacent side wall of the piston 36.

As clearly shown in FIG. 5, the eccenter assembly 50 is formed in two diametrically separated halves 88-and 90 centered on the axis of rotation of the assembly. The two parts 88 and 90 have two pairs of aligned recesses 92 and 94 in the opposed faces thereof which receive pins 96 to ensure the two parts are correctly lined up. The two parts 88 and 90 of the eccenter assembly are secured together by screw threaded headed fasteners 98 and 100 which engage correspondingly screw threaded openings 102 and 104 respectively in the first eccenter 52 and the second eccenter 54. The openings 102 and 104 extend perpendicularly to the opposed faces of the two parts 88 and 90 of the eccenter assembly with the portions in the part 88 being blind at one end and the open-ended portions in the part 90 being shouldered to receive the head 106 of the associated fastener. The heads 106 of the fasteners are recessed sufficiently that they do not protrude from the respective openings when the assembly 50 is assembled.

When assembled, the eccenter assembly 50 defines a passage 108 therethrough through which the crank pin portion 32 extends. The portion of the passage 108 axially remote from the flange 84 is rebated to receive the plain bearing 78 which itself is formed in two halves corresponding to the respective halves of the passage 108 defined by the eccenter assembly parts 88 and 90. The eccenters 52 and 54 are immediately adjacent to each other with the eccenter 52 disposed immediately adjacent the flange 84 and connected thereto by a short web 110. Each of the eccenter assemblies 52 and 54 has a peripheral annular portion 112 which is slightly recessed to receive the respective guide block 56 and 60. The openings 102 and 104 open into these recessed peripheral portions 112.

Figures 5A, 5B, 5C, 6:
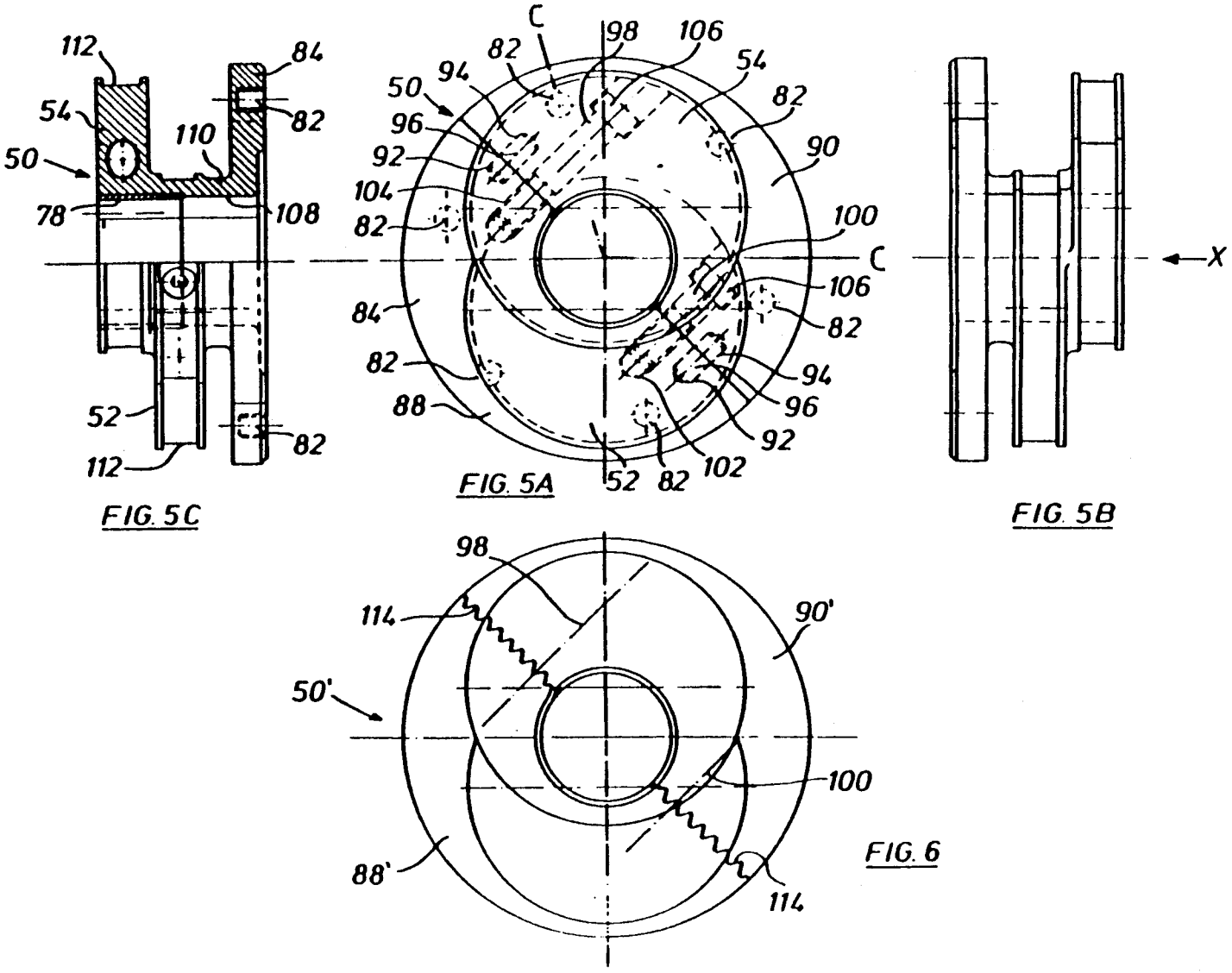
FIGS. 5A to C are various views of an eccenter assembly used in the rotary piston engine of FIGS. 3 and 4, 5A being a view taken in the direction X of FIG. 5B which is a similar view of the eccenter assembly as shown in FIG. 3 except that the assembly has been inverted.
FIG. 6 is a view similar to FIG. 5A except showing a modified form of the eccenter assembly.

FIG. 6 illustrates an alternative eccenter assembly 50' in which the sole modification is to replace the plane opposed faces of the eccenter assembly parts 88 and 90 and locating pins 96 by an accurately saw-toothed joint 114 with the two parts 88' and 90' being again secured together by screw threaded fasteners 98 and 100 illustrated schematically. In all other respects the eccenter assembly 50' may be identical to the eccenter assembly 50.

Figure 7A:
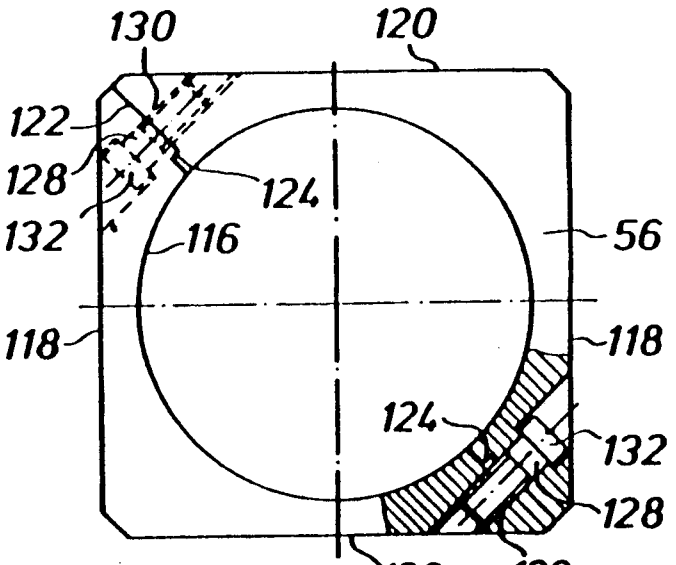
FIG. 7A is a part sectional elevational view of a guide block used with the eccenter assembly.
Figure 7B:
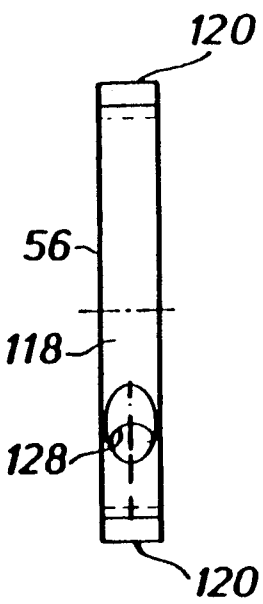
FIG. 7B is a side view of the guide block taken from the right in FIG. 7A.

Referring now to FIGS. 7A an 7B, one of the guide blocks 56 and 60 is illustrated. The two guide blocks are identical, and for convenience only one, 56, will be described in detail. The relatively flat guide block has a central bore 116 which is sized to provide a sliding fit without any slack on the peripheral surface 112 of the eccenter 52. The guide block 56 is rectangular with opposed pairs 118 and 120 of parallel flat edge surfaces, of which at least the surfaces 120 are preferably accurately machined to provide the necessary slide surfaces in engagement with the housing 12. Advantageously the guide block 56 is square with both pairs of opposed surfaces 118 and 120 being accurately machined so that should the pair 120 become worn the guide block 56 may be rotated axially through 90° whereby the other pair 118 can be used to define the slide surfaces.

Figure 8:
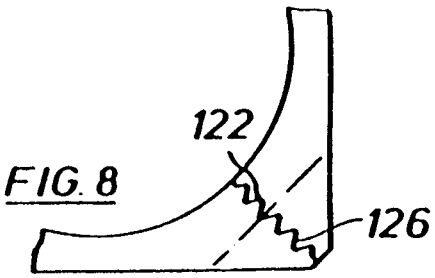
FIG. 8 illustrates a modification to part of the guide block of FIGS. 7A and B.

The guide block 56 is split substantially diagonally as shown by line 122, with the split line incorporating an accurate alignment device which in FIG. 7A comprises steps 124. An alternative saw tooth alignment device 126 is illustrated in FIG. 8. The two parts of the guide block 56 are secured together by headed threaded fasteners 128 received in corresponding openings 130, with the openings being rebated so as to receive the heads 132 of the fasteners in recessed manner.

Figure 9:
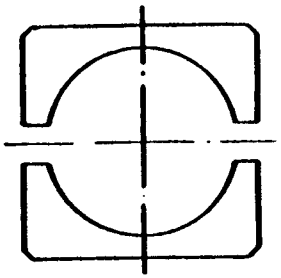
FIG. 9 schematically illustrates a further embodiment of the guide block.

For a lower performance lower speed machine, such as some stationery engines or pumps, a two piece guide block not split diagonally, such as that illustrated schematically in FIG. 9, may be appropriate. The alternative guide block pieces may be secured together by appropriate fasteners or may remain separate.

The guide block 56 and 60 are formed in two parts in order to enable them to be located on the recessed peripheral portions 112 of the eccenters 52 and 54, and the assembly of the engine 64 will now be described.

Referring again to FIGS. 3 and 4, the single piston rotary piston engine 64 is assembled by first mounting the eccenter assembly 50 on the crank pin portion 32 of the crank shaft 14 by taking the two parts 88 and 90 with the respective portions of the plain bearing insert 78 and fitting them over the crank pin portion 32 while ensuring that they are aligned correctly by means of the locating pins 96. The two parts are then secured together by means of the fasteners 98 and 100, noting that the fastener 98 and its corresponding opening 104 has a greater length than the fastener 100 and its opening 102. Module 22 of the housing 12 conveniently has removable parallel opposed slide members 134 of angled cross-section which are seated on a corresponding shoulder of the main body of the module 22 and secured thereto by means of respective fasteners 136 (one only shown). The slide members 134 define the parallel guide surfaces 58 for the guide block 56 and may be formed of appropriate low friction material. The module 22 is located over the eccenter 52, with the slide members 134 removed, by passing the module over the web 34 of the crank shaft 14 and tilting the module and/or rotating the eccenter assembly 50 as the module is moved axially towards the crank pin portion 30 so as to locate the module between the flange 84 and eccenter 54 at the bottom of the eccenter assembly 50 in FIG. 3. Guide block 56 is then assembled over the eccenter 52 and secured by screw threadedly engaging the fasteners 128 in the respective openings 130. Once fully aligned with the eccenter 52 and cooperating guide block 56, the slide members 134 may be eased into position and securely fastened to the body of the module by fasteners 136. The module 22 incorporates a ring seal 138 which engages the flange 84 of the eccenter assembly 50 during all stages of rotation of the eccenter assembly. The ring seal may be separable from the module 22.

Since the engine 64 has only a single piston and eccenter assembly, the piston 36 and modules 20 and 24 may be fitted before or after the guide block 60 and module 26. The guide block 60 is located on the eccenter 54 in the same manner as the guide block 56 is located on the eccenter 52, and when the fasteners 128 are satisfactorily tightened, the plain bearing 18 is fitted into the end module 26 and slid over the corresponding journal of the crank shaft 14 so that the guide surfaces 62 are radially aligned with the guide block 60. The end module 26 may also incorporate removable slide members (not shown) incorporating the guide surfaces 62 and similar to the slide members 134. The fly wheel 74 may then be secured to the crank shaft 14 by means of a threaded bolt 140 engaging a cooperating portion 142 of the shaft.

The plain bearing 38 is inserted into the piston 36 until it engages a shoulder 144 and the piston is then located over the crank pin portion 30. Prior to this action, an annular seal may be provided in a corresponding groove 146 in the side wall of the piston adjacent the module 22. With the bearing 38 abutting the shoulder 144, the flange 84 of the eccenter assembly 50 is closely received in the recess 86 in the piston side wall and with the openings 82 in the piston and flange 84 aligned, the threaded fasteners 80 may be engaged to secure the piston relative to the eccenter assembly. The correct alignment of the piston 36 with the eccenter assembly 50 is necessary to ensure the correct relationship between the movement of the guide blocks 56 and 60 and the position of the piston 36.

With the piston secured for rotation on the crank shaft, the module 20 housing the piston may be located in place with the main seals 48 (FIG. 4) in location. Annular piston seals may then be fitted in respective grooves 148 and 150 and the end module 24 with its main bearing 16 located on the associated crank shaft journal. The relative alignment of the modules 20, 22, 24 and 26 is maintained by threaded fasteners 152 which are shown schematically in FIG. 4 but omitted for clarity in FIG. 3. The pulley 76 may then be located on the crank shaft and secured by means of a threaded bolt 154 engaging a correspondingly threaded portion 156 of the shaft.

Figure 10:
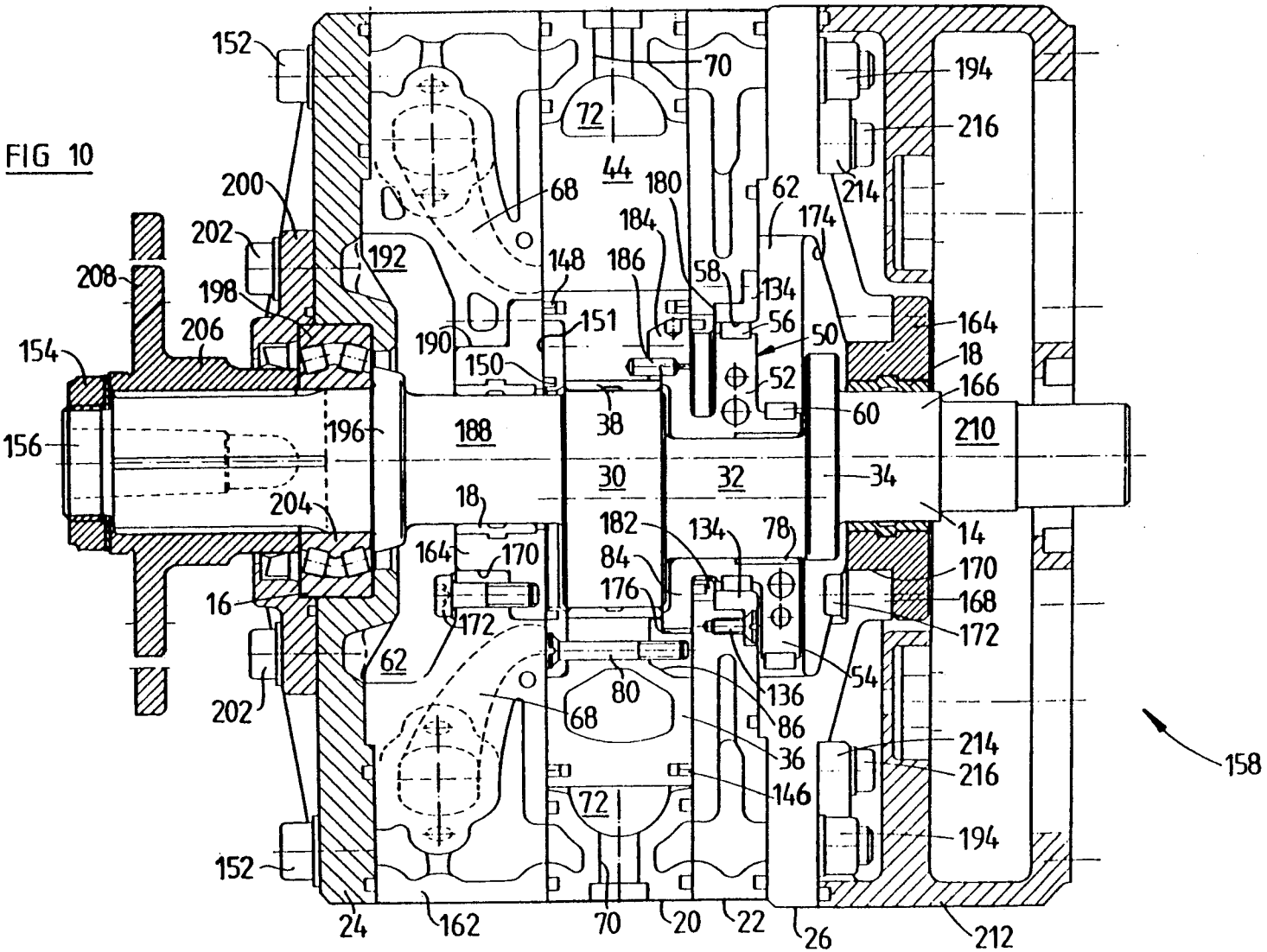
FIG. 10 is an axial section of a third embodiment of single piston rotary piston engine in accordance with the first aspect of the invention in modular form.

The single piston engine 64 shown in FIGS. 3 and 4 has a single combustion chamber 72 and corresponding working volume. However, the working volume and combustion chamber could be readily duplicated by providing a second port 70 and combustion chamber 72, together with cooperating Ports, at the bottom of the module 20 in FIGS. 3 and 4, opposed to the illustrated port 70 and combustion chamber 72, as illustrated in the embodiment of FIG. 10. The feature of the relatively short web 110 between the flange 84 of the eccenter assembly 50 and the eccenter 52 reduces the length of the crank pin 28 and therefore the distance between the bearings 16 and 18. Since the eccenter assembly 50 is separable from the piston 36 and is formed in two parts which permit it to be fitted radially over the crank pin 28, the crank pin portion 32 over which it is located can be of substantially reduced diameter compared to the crank pin portion 30 supporting the piston 36 thereby substantially reducing the eccentric rotating mass carried by the crank pin and reducing the overall size of the engine.

Referring now to FIG. 10, the single piston dual combustion chamber rotary piston engine 158 is a modified version of the engine 64 incorporating many similar parts and for convenience again the same reference numerals will be used for the same or similar parts. The engine 158 is in modular form and by increasing the length of the crank shaft 14 to include multiple throws and repeating the modules a multi-piston engine may be readily built. Such a four piston engine 160 is shown (at reduced scale) in FIG. 11 from which it may be seen that the modules 20, 22, 26 and 162 in FIG. 10 are identical to the right hand most modules 20, 22, 26 and 162 in FIG. 11 and that the opposite end modules 24 in each of the engines 158 and 160 are also identical. It will also be appreciated that the modules 20, 22 and 162 are repeated in the engine 160 for each of the four pistons 36, with the associated parts such as the eccenter assembly 50 and cooperating components and the bearings 18 also being repeated. For convenience, therefore, the engine 160 of FIG. 11 will primarily be described in relation to the single piston version 158 of FIG. 10. Furthermore, since many of the components of the engines 158 and 160 are substantially identical to the corresponding components in the engine 64 of. FIGS. 3 and 4, including the eccenter assembly 50 and guide blocks 56 and 60, these components will only be described in detail in relation to the engines 158 and 160 insofar as they differ from the corresponding components of the engine 64.

Referring then primarily to FIG. 10, the engine is assembled by locating the split bearing 18 and cooperating split bearing seat 164 on the end journal 166 of the crank shaft 14. The module 26 has an annular flange 168 defining an axial opening sufficiently large to enable the module to be passed the entire length of the crank shaft 14 from the left hand end in FIG. 10 (and FIG. 11) and the annular flange is then received on an annular shoulder 170 of the bearing seat 164. A plurality of bolts 172 (one only shown) secure the module 26 to the bearing seat 164. Alternatively, the bearing 18 and bearing seat 164 may be pre-assembled and the module 26 bolted to the bearing seat following which the journal 166 may be slid onto the bearing. The mounting of the module 26 on the journal 166 may be performed after assembly of the other modules of the engine 158.

The module 26 defines the opposed slide surfaces 62 for the cooperating guide block 60 of the eccenter assembly 50, and since the slide surfaces 62 are in an end face of the module 26 they may conveniently be readily machined. The opening 174 in the module 26 defining the slide surfaces 62 is sufficiently large to accommodate the web 34 of the crank pin. Alternatively the slide surfaces 62 may be defined on guide members such as the guide members 218 shown in FIG. 12 which are similar to the guide members 134.

The or each eccenter assembly 50 in the engines 158 and 160 is slightly modified compared to the eccenter assembly in the engine 64 in that the flange 84 is of somewhat reduced diameter to facilitate the assembly of the various components of the engine, and has an external screw thread 176 for reasons to be explained hereinafter. The two portions 88 and 90 of the eccenter assembly are located around the reduced diameter crank pin portion 32 of the crank shaft and secured in the manner previously described with the bearing insert 78. The guide block 60 is then secured around the eccenter 54 in the opening 174, in the manner previously described, and the guide block 56 is then correspondingly secured on the eccenter 52.

Module 22 has a generally rectangular axial opening as previously described with reference to FIGS. 2 and 4 which can be readily machined or cast and guide members 134 can be secured as shown in the opening by the associated fasteners 136 (only one shown) to define the slide surfaces 58 for the guide block 56. The guide members 134 project radially inwardly slightly from the main body of the module 22 to define a shoulder 180, but with the inserts 134 in place the opening in the module 22 is sufficiently large to pass the module over the crank shaft 14 from the left hand end in the FIGURES and over the reduced diameter flange 84 of the eccenter assembly 50 into engagement with the guide block 56. With the module 22 in place, a split annular sealing ring holder and sealing element 182 is located in the opening in the module against the shoulder 180.

An internally screw threaded engaging ring 184 is then threaded onto the flange 84 of the eccenter assembly 50 by means of the screw thread 176 and cooperating recesses in the ring 184 and flange 84 are aligned with the ring tightly engaged on the flange to receive a plurality of locking pins 186 (one only shown) which project from the ring 184. The recess 86 in the substantially cardioidal piston 36 is shaped to closely receive the ring 184 and has blind openings therein to closely receive the projecting portions of the pins 186. The piston with annular seals suitably received in the annular grooves. 146 and with bearing 38 in place is slid over the crank shaft until it is received on the larger diameter crank shaft portion 30 in engagement with the ring 184 and pins 186. A plurality of the screw threaded fasteners 80 secure the piston to the eccenter assembly 50 for accurate coaxial rotation therewith.

The module 20 defining the working volume 44 substantially corresponding to the outer envelope of the cardioidal piston 36 is then slipped over the crank shaft and piston into abutment with the module 22 which defines one side face of the working volume 44. The or each piston in the engines 158 and 160 rotates in a dual cylinder working volume 44 and two opposed combustion chambers 72 with corresponding spark plug or injector ports 70 are provided in the module 20.

Appropriate seals may then be fitted in the grooves 148 and 150 in the opposed side face of the piston, the seal 150 being provided in a reinforcing plate 151 of the piston, and a second split plain bearing 18 and bearing seat 164 may then be located over the journal 188 of the crank shaft 14.

In the engine 64, the end module 24 defines one side of the working volume 44, contains the porting 68 for the working volume 44 and supports the bearing 16. For the purposes of the modular construction which permits the same modules to be used in a single piston and a multiple piston engine, the end module 24 in the engines 158 and 160 supports a bearing 16 but the intermediate module 162 contains the porting 68 for the two working chambers in module 20, defines the adjacent side of the working volume 44 and supports the bearing seat 164 and the plain bearing 18. The module 162 has an annular flange 190 which is received in the corresponding recess 170 of the second bearing seat 164 and a plurality of fasteners 172 (one only shown) secure the second bearing seat 164 to the flange 190.

The porting 68 in the intermediate module 162 is shown schematically, but the module incorporates a recess 192 which in the single piston engine 158 serves no purpose other than reducing weight but which is necessary in the multiple piston engine 160 since it incorporates the slide surfaces 62 (or support surfaces for appropriate slide members) for the guide block 60 of the next adjacent eccenter assembly 50.

The end module 24 may then be abutted to the intermediate module 162 and the whole assembly is secured together by a plurality of bolts 152 and cooperating nuts 194. It will be appreciated that the alignment of the various modules 20, 22, 24, 26 and 162 is vitally important and while this will be provided to some extent by the bolts 152, locating studs and corresponding recesses may be provided on the various side surfaces of the modules.

In the engines 158 and 160 the bearing 16 comprises a thrust roller bearing assembly which engages a flange 196 of the crank shaft 14 to take up any axial slack in the crank shaft, which slack may conveniently be provided to facilitate assembly of the engine. The outer race 198 of the bearing assembly 16 is secured in place against a shoulder of the module 24 by an end cap 200 secured to the module 24 by means of bolts 202. The inner race 204 is urged against the flange 196 of the crank shaft by a thrust element 206 received on the end of the crank shaft 14 and biased by means of the nut 154 received on the screw threaded end portion 156. The thrust member 206 incorporates an annular flange 208 to which the pulley 76 (shown in FIG. 3 but not in FIGS. 10 and 11) or a corresponding Power take-off arrangement (including a propeller) may be secured. At the other end, the fly wheel 74 (not shown in FIGS. 10 and 11) or auxiliary device gears or elements may be received on the end portion 210 of the crank shaft and protected by means of a housing 212 incorporating a Plurality of webs 214 which receive bolts 216 by which the housing 212 is secured to the end module 26.

The fly wheel utilised with the single Piston engine 158 would be used to balance the engine but, as before, the balancing would be minimal in view of the minimal diameter of the eccenter assembly 50 and cooperating parts received on the reduced diameter portion 32 of the crank pin 28. However, in FIG. 11 the engine 160 is essentially balanced by the four pistons so that the fly wheel may not be needed or may provide only a minor balancing action. For convenience of illustration the engine 160 is shown with the adjacent crank pins 28 and corresponding pistons 36 at 180° to each other. In practice, this would produce an engine with two power strokes on top of the engine and two on the bottom of the engine (in FIG. 11) for each 180° of rotation of the crank shaft. The preferred arrangement is for the crank pins to be positioned on the crank shaft in such a way that a firing stroke occurs every 45° of crank shaft rotation. To achieve this, the crank pins would be offset at the appropriate angles to achieve a firing stroke every 45° of crank shaft revolution so that there are eight firing strokes (one for each combustion chamber 72) every 360° of crank shaft revolution. It will be noted that in the engine 160 each piston 36 has an associated eccenter assembly 50 and the corresponding modules for each piston and eccenter assembly are aligned so that the inlet and exhaust ports 68 and the ports 70 can all be aligned, allowing for simple manifolding, manufacture and service.

Figure 11:
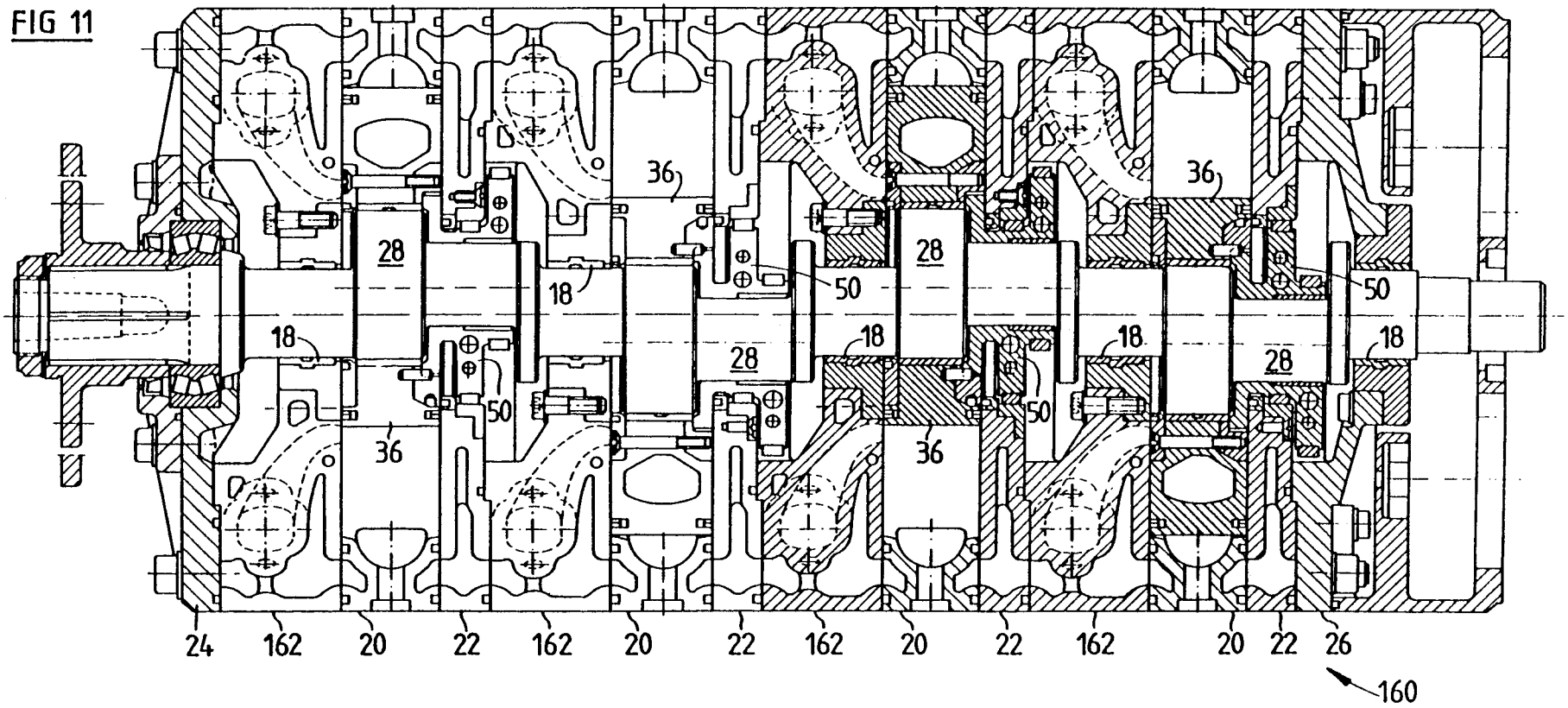
FIG. 11 is an axial section of a multi piston rotary piston engine in accordance with the first and second aspects of the present invention utilising the modules of FIG. 10.

In FIGS. 10 and 11, some fluid flow channels are shown,, but not described, but for ease of understanding the drawings not all of the sectioned parts have been given sectioning lines.

Figure 12:
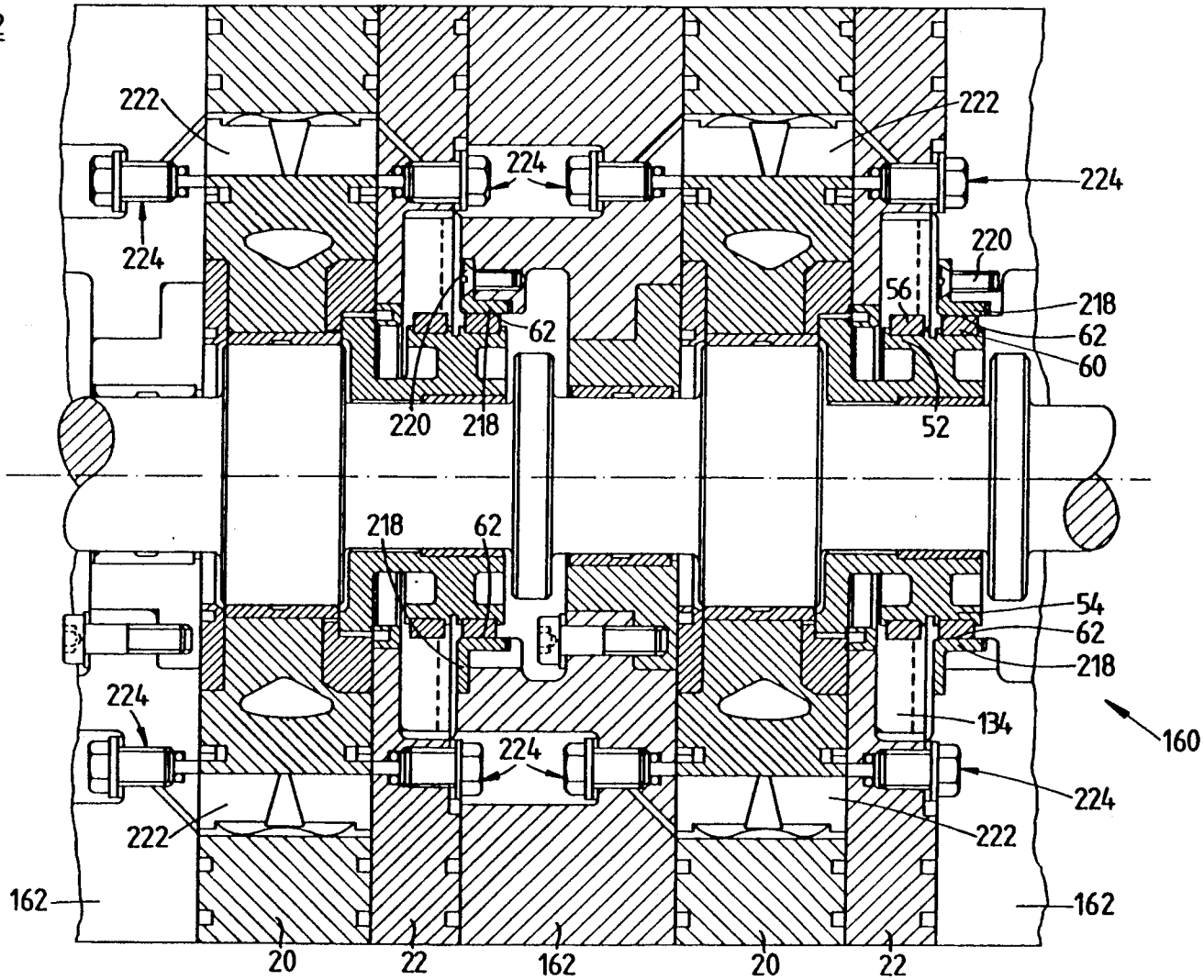
FIG. 12 is an enlarged axial section of part of the engine of FIG. 11 taken at 90° to the axial section of FIG. 11.

FIG. 12 is an axial section of part of the engine 160 taken normal to the section in FIG. 11. The view in FIG. 12 is enlarged compared to FIG. 11 and clearly illustrates one possible sealing arrangement for the pistons 36 in the engine 160. The view is from one of the intermediate modules 162 to the next-but-one intermediate module and shows a modification in which the slide surfaces 62 for the guide block 60 of eccenter 54 are formed on respective guide members 218 of identical shape and description to the guide members 134 for the guide block 56 of eccenter 52. The guide members 218 are secured to the respective intermediate module 162 by screw threaded fasteners 220. Usually at least two such fasteners 220 would be used with each guide member 218.

As described with reference to FIGS. 2 and 4, each substantially cardioidal piston 36 during its rotation around the crank shaft 14 remains in sealing contact at all times with the wall 46 of the respective module 20 defining the working volume 44 at two locations, the opposed inflexions of the outer envelope of the cardioid. The seals 48 are provided at these locations to provide the sealing contact. The seals 48 are shown schematically in FIGS. 2 and 4, and the preferred form of radial seal 222 is shown in greater detail in FIG. 13. Also shown in FIG. 13 in greater detail is a respective side wall seal assembly 224 associated with each of the radial seals 222 at each side of the associated piston.

Figure 13:
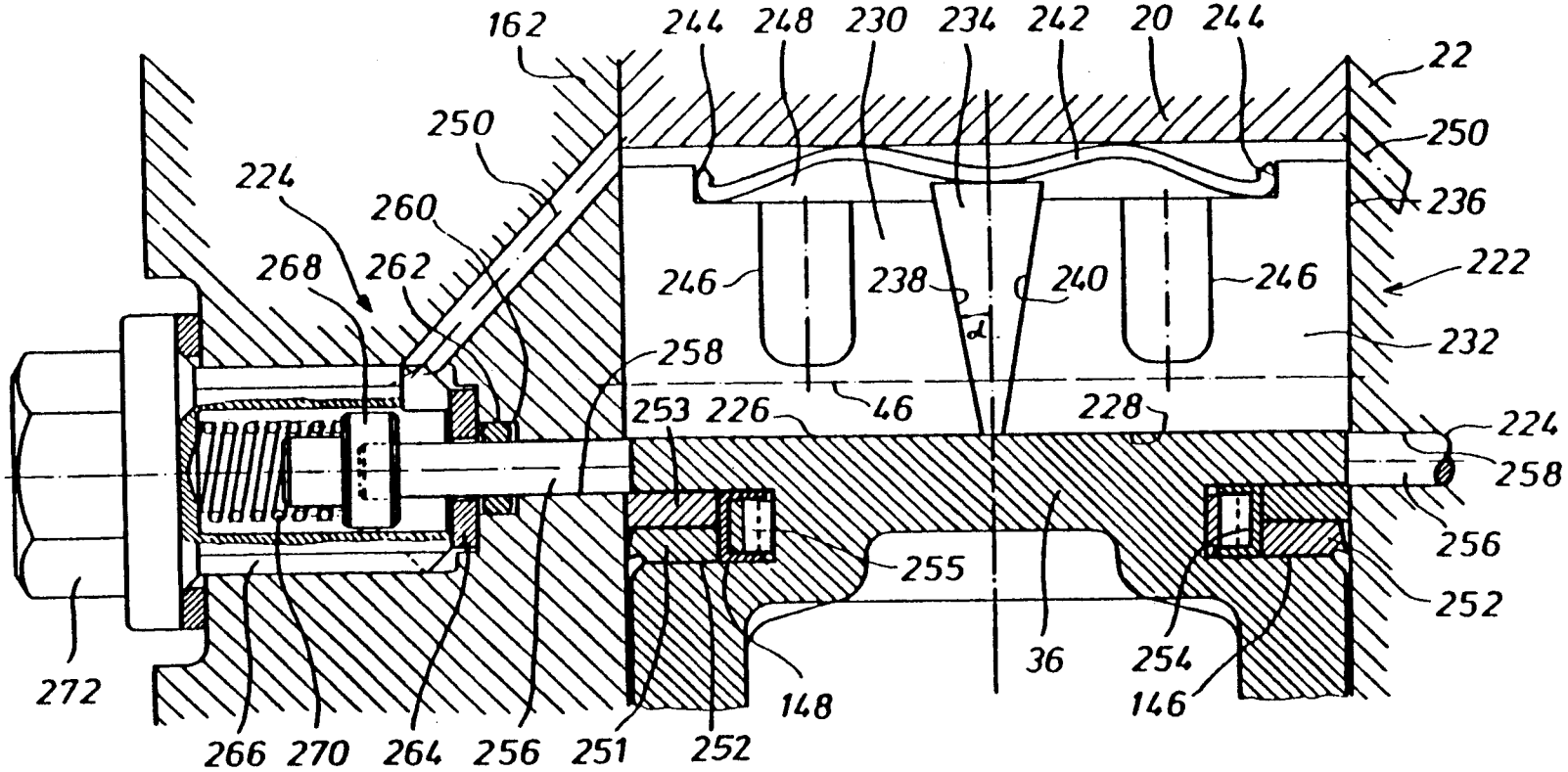
FIG. 13 is a detailed view of one set of the seal assemblies shown in FIG. 12.

All of the radial seals 222 are identical and all of the side wall seal assemblies 224 are identical and FIG. 13 is an enlarged portion showing one of the radial seals 222 and one complete seal assembly 224. The piston 36 has a top surface 226 of linear cross-section all around its periphery including the portion 40 of the cardioid, and the radial seal 222 projects into the working volume 44 and has a corresponding sealing surface 228 which extends substantially the full width of the working volume 44 in the housing module 20 between adjacent modules 162 and 22. This is ensured by means of a seal assembly which comprises a pair of outer components 230 and 232 interspaced by a wedge shaped component 234. Each of the components 230, 232 and 234 has a narrow generally rectangular cross-section as illustrated schematically with the radial seals 48 in FIGS. 2 and 4, with the aligned components 230, 232 and 234 being received in a correspondingly narrow recess 236 in the module 20. The recess 236 is open at the sides to the adjacent modules. The sealing surface 228 of the radial seal 222 is preferably convex in cross-section.

The components 230 and 232 have opposed inclined inner end surfaces 238 and 240 with the angle of inclination corresponding to the taper of the wedge shaped component 234. The angle of inclination of each inner end surface 238 and 240 may be in the range of, for example, 1° to 45° preferably as shown about 10° to 12° and equal to each other. The length of the sealing surface 228 defined by the components 230 and 232 is such that, at least when the seal is new, the spacing between these components at the sealing surface is for example, about 1 mm. The portion of the sealing surface 228 not made up by the components 230 and 232 is made up by the wedge-shaped component 234. A leaf spring 242 is received in the closed end portion 248 of the recess 236 between the seal components 230, 232 and 234 and the housing module 20 and extends between opposed shoulders 244 on the end components 230 and 232. The leaf spring is shaped so as to also engage both the housing module 20 at the closed end 248 of the recess and the wedge shaped component 234 and thereby urge all of the components into engagement with the peripheral surface 226 of the piston, and at the same time, urge the seal components 230 and 232 laterally into sealing engagement with the respectively adjacent modules 162 and 22.

While the action of the leaf spring 242 on the opposed shoulder 244 of the seal end components 230 and 232 does provide some biasing of those components towards the opposed ends of the recess 236 defined by the modules 162 and 22, the principal lateral bias is by virtue of the resilient biasing of the wedge shaped intermediate seal component 234 towards the peripheral working surface 226 of the piston whereby the wedging surfaces 238 and 240 urge the end seal components 230 and 232 into the sealing contact with the ends of the recess 236. Thus the continuous sealing surface 228 is maintained along the end and intermediate seal components.

The ends of the recess 236 defined by the modules 162 and 22 extend in respective radial planes perpendicular to the axis of rotation 15 of the crank shaft 14 and to the peripheral working surface 226 of the piston, and the end sealing surfaces of the seal end components 230 and 232 are parallel to the ends of the recess and therefore also perpendicular to the sealing surface 228 of the radial seal 222. The end sealing surfaces of the seal end components 230 and 232 intersect the radial sealing surface 228 at respective right angles to thereby provide a seal fully across the working volume 44.

The seal components 230, 232 and 234 may be made of known seal materials such as cast iron incorporating spheroidal graphite or appropriate ceramic or sintered materials, but the wedge shaped component 234 is preferably less wear resistant than the components 230 and 232 so that any part protruding from the main sealing surface 228 will be quickly worn down to the correct shape by rubbing on the peripheral surface 226 of the piston.

During its rotation, the piston 36 may tend to wobble slightly, and as it wobbles it may slide across the sealing surface 228 without tending to lift the seal components out of sealing contact with the ends of the recess.

Figure 15:
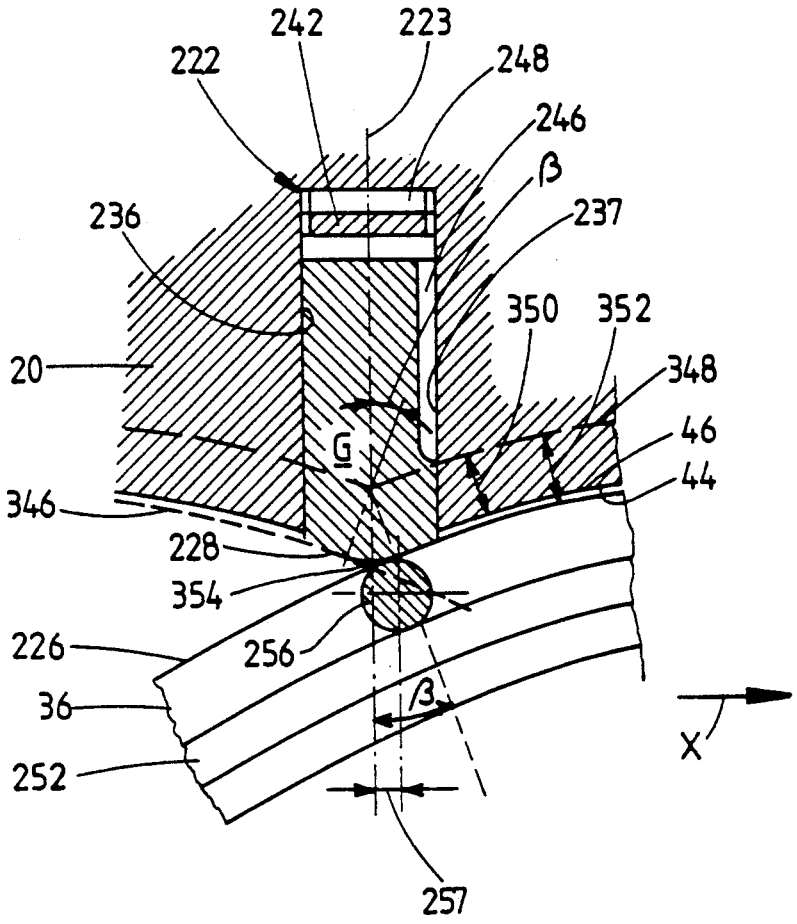
FIG. 15 is a cross-sectional view taken on the line 15—15 of FIG. 13 showing an arrangement in which the radial seal communicates with only a single combustion chamber.
Figure 16:
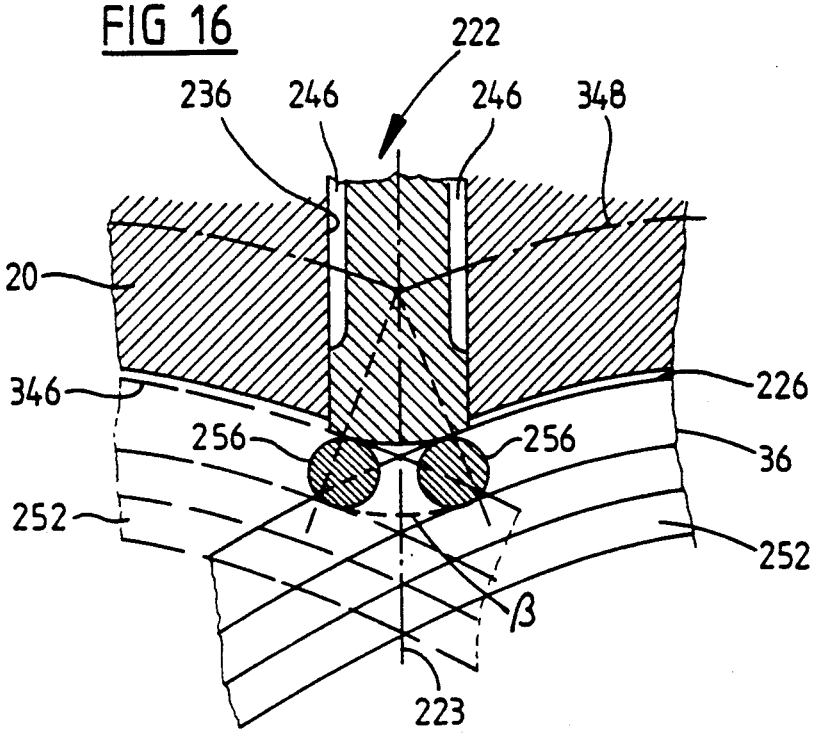
FIG. 16 is a view similar to part of FIG. 15 except that it illustrates one proposal for a dual combustion chamber arrangement.

The seal components 230 and 232 have rebates 246 in the side facing towards the combustion chamber 72 in the housing module 20 (or in the case of two combustion chambers 72 in the one housing module as in the engines 158 and 160 on both sides of the seal components as shown in FIGS. 16 and 15) to facilitate rapid build up of gas pressure from the combustion chamber in the closed end 248 of the recess 236 behind the seal components by passage of the combustion gases between the adjacent recess wall 237 (FIG. 15) and that side of the seal components. The direction towards the adjacent combustion chamber is indicated by the arrow X in FIG. 15. The build up of pressure in the closed end portion 248 biases the seal components against the piston surface 326 and, by virtue of the wedging effect of the intermediate seal component 234, also against the ends of the recess 236 defined by the adjacent modules 22 and 162, thus improving the sealing effect. This pressurizing effect is intermittent, with combustion in the working volume 44.

A passage 250 extends through each of the adjacent housing modules 162 and 22 from the closed end portion 248 to each of the opposed side sealing assemblies 224 to permit combustion gas pressure to also urge those seals into better engagement with the respective side surface of the piston.

In FIG. 13, only one of the associated side seal assemblies 224 has been shown complete, but the two opposed seal assemblies 224 are mirror images of each other and for convenience only the one will be described in detail.

The piston 36 has peripheral side seals 252 of known design disposed in the annular grooves 146 and 148 in the side wall thereof to engage the adjacent side wall of the working volume 44 defined by the respective modules 22 and 162. Each of the peripheral side seals 252 comprises two seal members 251 and 253 supported side by side in the respective groove 146 or 148 on an annular channel-shaped support member 254 which by means of a wave-spring 255 received in the channel of the support member within the groove biases the seal members axially outwardly into engagement with the side wall of the working volume.

The seal members 251 and 253 may be formed of cast iron while the support member 254 may be formed of a high temperature elastomer or, for example, stainless steel.

The peripheral side seals 252 are intended to prevent leakage of combustion gases from one or other the combustion chambers 72 around the side of the piston 36 to the opposite, low-pressure side of the working volume 44. For this purpose, since the or each combustion chamber 72 is disposed adjacent the peripheral edge 226 of the piston the peripheral side seals 252 should be disposed in the side walls of the piston as close as possible to the peripheral edge. However, for practical reasons it is necessary for the peripheral side seals 252 to be slightly set back from the peripheral edge 226 of the piston which tends to permit the combustion gases to leak along the side walls of the piston between the peripheral side seals 252 and the radial seal 222. The side seal assemblies 224 are designed to alleviate this leakage.

Each seal assembly 224 comprises a plunger 256 which is biased into contact with the respective side wall of the piston 36 between the peripheral side seal 252 and the radial seal 222. The plunger may be formed of known sealing materials, including the aforementioned materials of the radial seal components 230, 232 and 234 but preferably is formed of a material softer than that of the radial seal components 230 and 232. The plunger extends through a passage 258 in the respective module 22 or 162, which passage extends in stepped manner wholly through the module parallel to the axis of rotation of the drive shaft. Adjacent the piston 36, the passage 258 provides a close sliding fit for the plunger 256 and is then stepped at 260 to seat an O-ring seal 262. Moving back from the piston 36, the passage 258 is stepped again to receive an end plate 264 through which the plunger 256 projects, from where the passage 258 opens into a main chamber 266 which is internally screw threaded. The passage 250 from the closed end portion 248 behind the radial seal 222 opens into the main chamber 266 adjacent the end plate 264. The plunger 256 projects into the chamber 266 and at that end is frictionally engaged with a flanged element 268 from which it may be separated which provides a seat for a compression spring 270. The other end of the spring bears against the blind end of a hollow externally screw threaded stud 272 which is screwed down onto the internal screw thread of the main chamber 266 to compress the spring 270 and bias the plunger 256 into engagement with the piston side wall. The stud 272 has a hexagonal head clearly shown in FIG. 12 but which has been partly omitted for clarity in FIG. 13.

As the piston 36 wobbles in the housing module 20 the side seal assemblies 224 will move in and out to compensate for the piston's sideways movement. The peripheral side seals 252 also tend to adjust to any sideways movement of the piston. As pressure builds up in the closed end portion 248 behind the radial seal 222, as previously described, the increased pressure will be transmitted along the passage 250 into the main chamber 266 of the passage 258 and into the hollow portion of the stud 272 where the increased pressure will bear against the plunger flange element 268 and increase the bias on the plunger 256 against the piston side wall.

It will be understood particularly from FIG. 12 that access to the stud 272 to secure the side seal assembly 224 in place may be from the opposite side of the respective module 22 or 162 to that from which the plunger 256 projects. Without the piston 36 in the working volume 44 the plunger 256 may be removed and replaced by separating it from the flange element 268 and drawing it through the passage 258 into the working volume 44.

Referring to FIG. 15, the plunger 256 is preferably of cylindrical cross-section and is preferably positioned at least approximately with one part of its periphery tangential to the piston peripheral surface 226 and to the tip 228 of the radial seal 222 and with another part of its surface tangential to the adjacent side of the peripheral side seal 252 so as to bridge the gap between the radial seal 222 and the peripheral side seal 252. The plunger 256 may have its axis extending along the central plane 223 of the radial seal 222, particularly for a twin combustion chamber arrangement such as in the engine 160. Ideally in a single combustion chamber arrangement as shown in FIG. 15, the plunger 256 is disposed slightly offset to the combustion chamber side (x) of the housing module 20 to provide maximum sealing effect at the same time as the highest pressures occur in the marking volume 44. This will usually occur at about 10° to 21° from the central plane 223 of the radial seal 222 towards the combustion chamber in the direction X and the selected offset is shown at 257.

In FIG. 15, the corresponding portion of the piston 36 and of the peripheral side seal 252 is shown in outline only, and the dashed line 346 illustrates the path of the peripheral working surface 226 as the piston moves around the working volume 44.

Neither the piston peripheral working surface 226 nor the cooperating working surface 46 of the working volume 44 in fact define a true trochoid, and the true trochoid is shown in part at 348. Arrow 350 indicates what is known as the equidistant of the true trochoid 348 to the inside envelope of the housing module 20, which corresponds to the cooperating working surface 46 and arrow 352 indicates what is known as the equidistant of the true trochoid 348 to the piston envelope, which corresponds to the path 346 of the peripheral working surface 226 of the piston.

The sealing surface 228 of the radial seal 222 has a central tip 354, the sealing surface 228 corresponds in shape generally to the peripheral working surface 226 of the piston.

In an alternative embodiment, shown in FIG. 16, for a twin combustion chamber arrangement, two side seal assemblies 224 incorporating respective plungers 256, or one side seal assembly 224 incorporating dual plungers 256, which may be independently or jointly spring biased, may be disposed adjacent each of the opposed sides of the piston 36 with the two plungers respectively offset as described above towards the associated combustion chambers. As may be seen in FIG. 16, the radial seal 222 has rebates 246 on both sides of the seal components.

Figure 17:
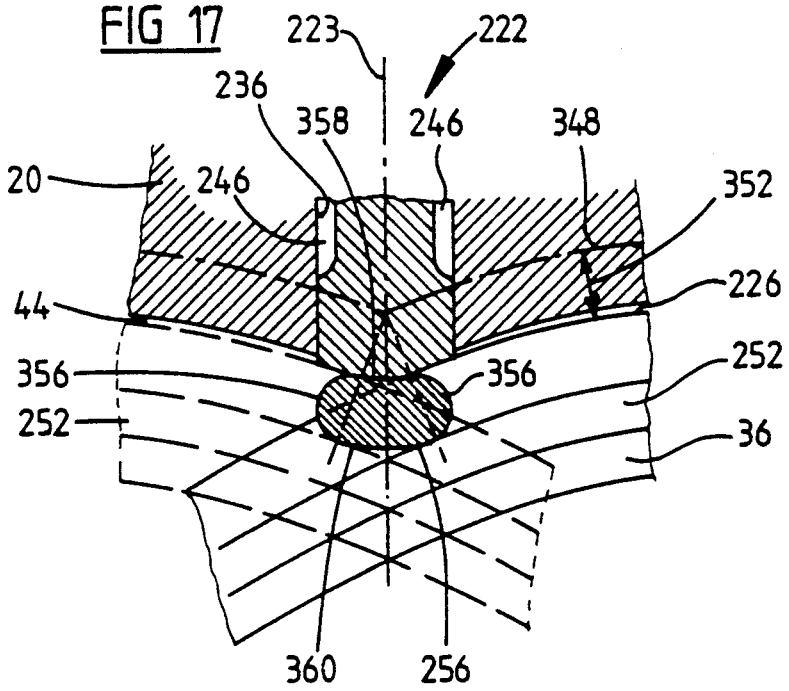
FIG. 17 is a view similar to FIG. 15 except that it shows a further proposal for a dual combustion chamber arrangement.

In an engine with two combustion chambers at respective ends of the housing module 20, an even more efficient but slightly more expensive to manufacture form of the side sealing assembly plunger 256 is shown in FIG. 17. In this case, the cross-section of the plunger is essentially kidney-shaped and comprises two substantially semi-circular ends 256, a concave section 358 of radius equal to the distance 352 between the true trochoid 348 and the piston envelope and a convex section 360 of radius equal to the distance between the true trochoid 348 and the radially outer edge of the peripheral side seal 252. The kidney-shaped plunger 256 extends across the central plane 223 of the radial seal 222 so that the substantially semi-circular ends 356 of the plunger correspond essentially to the two individual plungers 256 described with reference to FIG. 16. This shape of plunger 256 effectively seals the gap between the piston 36 and the side walls of the adjacent housing modules 22 and 162 between the peripheral working surface 226 of the piston and the peripheral side seals 252. With this configuration of plunger 256, this gap is sealed at all positions of the piston and not mainly at the same time as the highest pressures apply in the working volume 44.

The plunger 256 is preferably of a material such as lead bronze softer than the adjacent portion of the radial seal 222 so that, as the radial seal wears with use of the engine, if the end portion of the seal 222 which overlies the gap between the piston side wall and adjacent housing module 162 or 22 (clearly visible in FIG. 13) does not wear as quickly, the end portion of the radial seal will embed into the material of the plunger 256, thereby ensuring continued effective sealing across the peripheral working surface 226 of the piston 36 by the radial seal 222.

It will be readily appreciated that the side sealing assembly 224 may be used with many different forms of radial seal, including a one-piece seal component.

Figure 14:
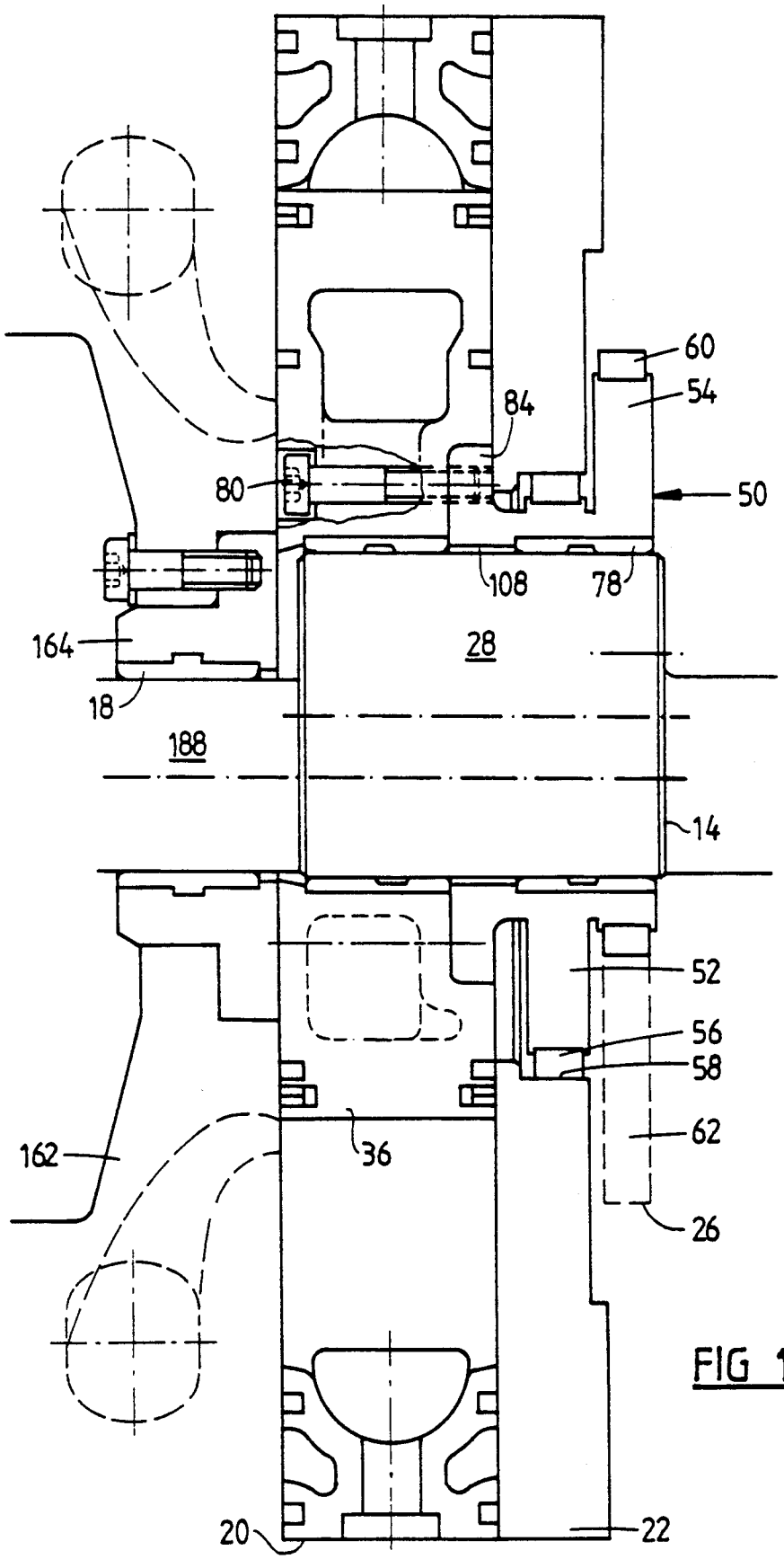
FIG. 14 is an enlarged view of some of the modules of FIG. 10 inverted and adapted to accommodate a modified crank shaft.

Referring now to FIG. 14, there is shown a modified portion of an engine in which the crank pin 28 of the crank shaft 14 is not stepped. Thus, the eccenter assembly 50 is mounted on a portion of the crank pin 28 which is of the same diameter as the portion on which the piston 36 is mounted. The module 20 in FIG. 14 is identical to the corresponding modules in FIGS. 10 and 11, but the piston 36 is connected directly to a flange 84 of the eccenter assembly 50 by means of a plurality of screw threaded fasteners 80 generally as described with reference to FIGS. 3 and 4. The eccenter assembly 50 is supported at its remote end on the crank pin 28 by means of a bearing 78 which is received in an enlarged passage 108 of the eccenter assembly. The eccenters 52 and 54, the guide blocks 56 and 60 and the openings in the modules 22 and 26 or 162 defining or carrying the slide surfaces 58 and 62 all require slight enlargement compared to the previously described embodiments to accommodate the non-stepped crank pin, but the length of the crank pin 28 and the length of the combined piston and eccenter assembly in the embodiment of FIG. 14 need not be any greater than the previously described embodiments since the eccenters are secured directly to and immediately adjacent the piston. Furthermore, the feature that the eccenter assembly 50 is separable from the piston 36 enables the journal 188 of the crank shaft 14 on which the plain bearing 18 and bearing seat 164 are located to be of minimal length even in a multiple piston machine since the journal 188 need only accommodate the length of the piston, without the eccenter assembly, during assembly.

Those skilled in the art will appreciate that the invention described herein is susceptible to variations and modifications other than those specifically described. It is to be understood that the invention includes all such variations and modifications which fall within its spirit and scope.

I claim:

1. A rotary piston machine of trochoidal construction comprising a rotatable drive shaft having an eccentric portion and supported for rotation in two spaced bearings, a piston eccentrically mounted on the eccentric portion of the drive shaft for contra rotation relative thereto in a housing, the piston being of epitrochoidal type with 1:1 generating circles and defined with an outer envelope and the housing having a co-operating working surface for the piston which substantially conforms to the outer envelope of the epitroichoid, and a piston follow-up mechanism comprising a pair of relatively offset eccenters mounted for eccentric rotation about the eccentric portion of the drive shaft with the piston, said eccenters being rotatably mounted in respective guide members which are constrained by respective guiding means to reciprocate rectilinearly along angularly offset paths with rotation of the piston, the pairs of eccenters being located immediately adjacent the piston and secured for rotation directly therewith whereby to reduce the length of the eccentric portion of the drive shaft, and wherein the eccentric portion of the drive shaft comprises a stepped crank pin with the portion about which the eccenters rotate being of reduced diameter relative to the portion about which the piston rotates.

2. A rotary piston machine according to claim 1 wherein the pair of eccenters is separable from the piston.

3. A rotary piston machine according to claim 1 wherein the pair of eccenters is mounted for rotation about the drive shaft in engagement therewith.

4. A rotary piston machine according to claim 1 wherein the drive shaft is in one piece.

5. A rotary piston machine according to claim 1 wherein the pair of eccenters is disposed to the same side of the piston.

6. A rotary piston machine according to claim 5 wherein the pair of eccenters is separable from the piston and is split along one or more axial planes to facilitate location about the drive shaft.

7. A rotary piston machine according to claim 1 wherein each guiding means comprises opposed parallel straight walls of the housing defining a guide path in which a respective one of the guide members is free to slide.

8. A rotary piston machine according to claim 7 wherein each guide member comprises a guide block defining a first pair of opposed side surfaces for sliding engagement with the guide path and a second pair of opposed side surface for optional sliding engagement with the guide path when the first pair becomes worn.

9. A rotary piston machine according to claim 1 wherein each guide member is split along one or more axial planes to facilitate assembly about the respective eccenter.

10. A rotary piston machine according to claim 1 which comprises an engine and wherein two combustion chambers are defined in the working surface.

11. A rotary piston machine according to claim 1 wherein the machine housing is in modular form with a first module containing the piston and defining the co-operating working surface therefor, a second module containing a first of the eccenters and respective guide member and carrying the respective guiding means, and a third module containing a second of the eccenters and respective guide member and carrying the respective guiding means.

12. A rotary piston machine according to claim 11 wherein a drive shaft main bearing is supported in the third module.

13. A rotary piston machine according to claim 1, wherein the machine housing comprises one module within which the piston rotates and defining the cooperating working surface and another module within which a first of the eccenters rotates and the respective guide member and guiding means are disposed, said another module defining an axial end wall of a working volume of the housing within which the piston rotates.

14. A rotary piston machine according to claim 1, wherein the housing has mounted in a recess at a convex inflexion of the cooperating working surface a radial seal having a sealing surface with extends acrose a peripheral working surface of the piston, the radial seal comprising a plurality of seal members which together define the sealing surface and which are biased towards the peripheral working surface of the piston, an intermediate seal member being resiliently biased and wedge spaced whereby under the resilient biasing action of said intermediate seal member opposed wedging surfaces thereof cooperate with adjacent seal members to urge opposed end seal members into sealing contact with respective ends of the recess.

15. A rotary piston machine according to claim 1, wherein the piston is eccentrically rotatably mounted in a working volume of the housing between opposed axial end walls and has a respective peripheral axial seal extending around each side wall thereof adjacent a peripheral working surface and in sealing contact with the adjacent axial end wall, the housing having at a convex inflexion of the cooperating working surface a radial seal having a sealing surface which extends across the peripheral working surface of the piston, and wherein side sealing means projects from at least one of the axial end walls of the working volume adjacent the radial seal and is resiliently biased into sealing contact with the respective side wall of the piston to at least substantially seal a gap between the radial seal and the respective peripheral axial seal.

16. A rotary piston machine of trochoidal construction comprising a rotatable drive shaft supported for rotation in spaced bearings, a plurality of pistons eccentrically mounted on respective eccentric portions of the drive shaft between two of the spaced bearings for contra rotation relative to the drive shaft in a housing, each piston being of epitrochoidal type with 1:1 generating circles and defined with an outer envelope and the housing having respective co-operating working surfaces for the pistons each of which substantially conforms to the outer envelope of the respective epitrochoid, and piston follow-up means comprising a respective follow-up mechanism for each piston comprising a pair of relatively offset eccenters mounted for eccentric rotation about the respective eccentric portion of the drive shaft with the associated piston, said eccenters being rotatably mounted in respective guide members which are constrained by respective guiding means to reciprocate rectilinearly along angularly offset paths with rotation of the piston, and wherein a further one of the spaced bearings is disposed between adjacent eccentric portions of the drive shaft.

17. A rotary piston machine according to claim 16 wherein each pair of eccenters is located immediately adjacent the respective piston and is secured for rotation directly therewith whereby to reduce the length of the associated eccentric portion of the drive shaft.

18. A rotary piston machine according to claim 16 wherein the eccentric portions of the drive shaft are balanced.

19. A rotary piston machine according to claim 16 wherein the machine housing comprises for each piston and piston follow-up mechanism a first module within which the piston rotates and defining the co-operating working surface therefor and a second module within which a first of the eccenters rotates and the respective guide member and guiding means are disposed, said second module defining an axial end wall of a working volume of the housing within which said piston rotates.

20. A rotary piston machine according to claim 19 wherein the machine housing further comprises for each piston and piston follow-up mechanism a third module and one of the spaced bearings is supported in each third module.

21. A rotary piston machine according to claim 20 wherein each third module defines an axial opening for removably supporting the respective bearing, said axial opening being sufficiently large to permit the drive shaft to be passed therethrough.

22. A rotary piston machine according to claim 20 wherein for at least one of the pistons as opposed axial end wall of the working volume is defined by the third module of an adjacent assembly of piston and piston follow-up mechanism.

23. A rotary piston machine according to claim 22 wherein said adjacent third module contains porting for the working volume of said first module.

24. A rotary piston machine according to claim 19 wherein a thrust bearing for the drive shaft is supported in an end module of the machine housing.

25. A rotary piston machine according to claim 16, wherein the housing has mounted in a recess at a convex inflexion of the cooperating working surface for each piston a radial seal having a sealing surface which extends across a peripheral working surface of the piston, the radial seal comprising a plurality of seal members which together define the sealing surface and which are biased towards the peripheral working surface of the piston, an intermediate seal member being resiliently biased and wedge spaced whereby under the resilient biasing action of said intermediate seal member opposed wedging surfaces thereof cooperate with adjacent seal members to urge opposed end seal members into sealing contact with respective ends of the recess.

26. A rotary piston machine according to claim 25, wherein the cooperating working surface has two or more convex inflexions and wherein a radial seal is mounted in a respective recess at each convex inflexion.

27. A rotary piston machine according to claim 25, wherein all of the seal members are resiliently biased towards the piston.

28. A rotary piston machine according to claim 25, wherein the seal members are resiliently biased into engagement with the ends of the recess.

29. A rotary piston machine according to claim 25, wherein the resilient biasing is achieved by fluid pressure behind the radial seal in the recess.

30. A rotary piston machine according to claim 28, wherein the location of the seal members in the recess is such that fluid pressure in the working volume between the piston and the cooperating working surface may enter the recess to urge the seal members into contact with the peripheral working surface of the piston.

31. A rotary piston machine according to claim 25, wherein the resilient biasing is performed by spring means.

32. A rotary piston machine according to claim 31, wherein the spring means comprises a leaf spring.

33. A rotary piston machine according to claim 25, wherein the opposed wedging surfaces of the intermediate seal member are inclined to the radial direction.

34. A rotary piston machine according to claim 33, wherein surfaces of the seal members other than the intermediate seal members which cooperate with the opposed wedging surfaces and correspondingly inclined.

35. A rotary piston machine according to claim 25, wherein the opposed wedging surfaces are equally and oppositely inclined.

36. A rotary piston machine according to claim 33, wherein the angle of inclination to the radial direction of each of the opposed wedging surfaces is in the range of 1° to 45°.

37. A rotary piston machine according to claim 36, wherein the angle of inclination to the radial direction of each of the opposed wedging surfaces is in the range 10° to 12°.

38. A rotary piston machine according to claim 25, wherein the intermediate seal member comprises from 0.1 to 10% of the length of the sealing surface.

39. A rotary piston machine according to claim 25, wherein the intermediate seal member is less wear resistant than the remaining seal members.

40. A rotary piston machine according to claim 25, wherein the opposed wedging surfaces of the intermediate seal member cooperate directly with the end seal members.

41. A rotary piston machine according to claim 25, wherein the housing is of modular construction with the piston being rotatable in a first module in which the recess is also provided, said recess being axially open-ended in said first module and wherein the ends of the recess are defined by adjacent modules.

42. A rotary piston machine according to claim 16, wherein each piston is eccentrically rotatably mounted in a respective working volume of the housing between opposed axial end walls and has a respective peripheral axial seal extending around each side wall thereof adjacent a peripheral working surface and in sealing contact with the adjacent axial end wall, the housing having at a convex inflexion of the respective cooperating working surface a radial seal having a sealing surface which extends across the peripheral working surface of the piston, and wherein side sealing means projects from at least one of the axial end walls of the working volume adjacent to the radial seal and is resiliently biased into sealing contact with the respective side wall of the piston to at least substantially seal a gap between the radial seal and the respective peripheral axial seal.

43. A rotary piston machine according to claim 42, wherein side sealing means project from respective axial end walls of the working volume and are resiliently biased into sealing contact with the respective side walls of the piston.

44. A rotary piston machine according to claim 42, wherein the resilient biasing is by spring means.

45. A rotary piston machine according to claim 44, wherein the spring means comprises a helical spring.

46. A rotary piston machine according to claim 42, wherein at least part of the resilient biasing is provided by fluid pressure.

47. A rotary piston machine according to claim 38, wherein a passage provides communication between the side sealing means and a recess in the housing in which the radial seal is received, said fluid pressure being developed in said recess and communicated with the side sealing means by way of the passage.

48. A rotary piston machine according to claim 42, wherein the housing is of modular construction with the piston and radial seal disposed in a first module and the side sealing means mounted in an adjacent module.

49. A rotary piston machine according to claim 42, wherein the portion of the side sealing means in engagement with the piston is positioned approximately with one part of its surface tangential to the peripheral working surface of the piston and the top of the radial seal, and another part of its surface tangential to the adjacent surface of the peripheral axial seal.

50. A rotary piston machine according to claim 42, wherein the portion of the side sealing means in contact with the piston is formed of a material softer than that of the adjacent portion of the radial seal.

51. A rotary piston machine according to claim 42, in which a combustion chamber is provided in the cooperating working surface and wherein the side sealing means is angularly offset from the radial seal axial center plane towards the combustion chamber.

52. A rotary piston machine according to claim 51, wherein said angular offset is in the range 10° to 21°.

53. A rotary piston machine according to claim 42, wherein two opposed combustion chambers are provided in the cooperating working surface and wherein two resiliently biased side sealings means are provided in said at least one of the axial end walls, each angularly offset from the radial seal axial center plane towards the respective combustion chambers.

54. A rotary piston machine according to claim 42, wherein two opposed combustion chambers are provided in the cooperating working surface and wherein the cross-section of the portion of the side sealing means in contact with the piston is substantially kidney-shaped with said portion centered on the radial seal axial center plane and with part circular ends of the kidney-shaped cross-section extending to respective sides of the center plane.

55. A rotary piston machine of trochoidal construction comprising a rotatable drive shaft having an eccentric portion and supported for rotation in two spaced bearings, a piston eccentrically mounted on the eccentric portion of the drive shaft for contra rotation relative thereto in a housing, the piston being of epitrochoidal type with 1:1 generating circles and defined with an outer envelope and the housing having a co-operating working surface for the piston which substantially conforms to the outer envelope of the epitrochoid, and a piston follow-up mechanism comprising a pair of relatively offset eccenters mounted for eccentric rotation about the eccentric portion of the drive shaft with the piston, said eccenters being rotatably mounted in respective guide members which are constrained by respective guiding means to reciprocate rectilinearly along angularly offset paths with rotation of the piston, the pair of offset paths with rotation of the piston, the pair of eccenters being located immediately adjacent the piston and secured for rotation directly therewith whereby to reduce the length of the eccentric portion of the drive shaft, and wherein the machine housing comprises one module within which the piston rotates and defining the cooperating working surface and another module within which a first of the eccenters rotates and the respective guide member and guiding means are disposed, said another module defining an axial end wall of a working volume of the housing within which the piston rotates.

* * * * *

UNITED STATES PATENT AND TRADEMARK OFFICE

CERTIFICATE OF CORRECTION

PATENT NO. : 5,295,814

DATED : March 22, 1994

INVENTOR(S) : Helmuth R. UEBEL

It is certified that error appears in the above-identified patent and that said Letters Patent is hereby corrected as shown below: Title page:

Item [75]: Inventor: should be Helmuth R. Uebel, Groton, 06340, United States of America--.

Signed and Sealed this

Twenty-eight Day of March, 1995

*Attest:*

*Attesting Officer*

BRUCE LEHMAN

*Commissioner of Patents and Trademarks*